US007231058B2

(12) United States Patent
Usuki et al.

(10) Patent No.: US 7,231,058 B2
(45) Date of Patent: Jun. 12, 2007

(54) ELECTROACOUSTIC TRANSDUCER AND ELECTRONIC APPARATUS

(75) Inventors: Sawako Usuki, Kobe (JP); Shuji Saiki, Uda-gun (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 515 days.

(21) Appl. No.: 10/742,944

(22) Filed: Dec. 23, 2003

(65) Prior Publication Data

US 2004/0136558 A1 Jul. 15, 2004

(30) Foreign Application Priority Data

Dec. 27, 2002 (JP) ..... 2002-381101

(51) Int. Cl.
*H04R 25/00* (2006.01)

(52) U.S. Cl. ..... 381/412; 381/408

(58) Field of Classification Search ..... 381/190, 381/191, 396, 399, 400, 401, 408, 420, 421, 381/422, 423, 431
See application file for complete search history.

(56) References Cited

U.S. PATENT DOCUMENTS 3,012,107 A 12/1961 Hanlet
3,141,071 A 7/1964 Rich
4,480,155 A * 10/1984 Winey ..... 381/408
5,764,784 A 6/1998 Sato et al.
5,901,235 A * 5/1999 Thigpen et al. ..... 381/431
5,905,805 A 5/1999 Hansen
6,154,557 A 11/2000 Montour et al.
6,658,133 B1 12/2003 Usuki et al.

FOREIGN PATENT DOCUMENTS

| | | |
|---|---|---|
| JP | 48-24721 | 3/1973 |
| JP | 08-140185 | 5/1996 |
| JP | 2001-231097 | 8/2001 |
| KR | 1984-0003571 | 9/1984 |

* cited by examiner

*Primary Examiner*—Sinh Tran
*Assistant Examiner*—Brian Ensey
(74) *Attorney, Agent, or Firm*—Wenderoth, Lind & Ponack, L.L.P.

(57) ABSTRACT

In an electroacoustic transducer of the present invention, a casing supports a diaphragm, a drive coil is provided on the diaphragm, a first magnetic structure has a first space in a center thereof provided within the casing such that a center axis penetrates the first space, and a second magnetic structure has a second space in a center thereof provided within the casing on a side opposed to the first magnetic structure with respect to the diaphragm, such that the center axis penetrates the second space. The first magnetic structure is oriented such that a magnetization direction thereof is parallel to the center axis. The second magnetic structure is oriented such that a magnetization direction thereof is opposite to the magnetization direction of the first magnetic structure.

18 Claims, 14 Drawing Sheets

ELECTROACOUSTIC TRANSDUCER AND ELECTRONIC APPARATUS

BACKGROUND OF THE INVENTION

1. Field of the Invention

The present invention relates to an electroacoustic transducer and an electronic apparatus including the electroacoustic transducer. More particularly, the present invention relates to an electroacoustic transducer having a structure in which magnets are provided both above and below a diaphragm, and also relates to an electronic apparatus including such an electroacoustic transducer.

2. Description of the Background Art

Recently, in the field of portable electronic apparatuses, such as a mobile telephone and a personal digital assistant (PDA), reduction in thickness and power consumption of an electronic apparatus has been accelerated. As in the case of the electronic apparatus, an electroacoustic transducer included in the electronic apparatus is demanded to reduce its thickness while achieving more efficient power consumption. Accordingly, in order to realize reduction in thickness and power consumption, an electroacoustic transducer as described below has been proposed.

FIG. 16 illustrates the structure of a conventional electroacoustic transducer. In the conventional electroacoustic transducer illustrated in FIG. 16, a casing 20 includes a circular cover 1 and a circular frame 2 joined to the cover 1. Each of the cover 1 and the frame 2 is open on one end. The cover 1 includes a plurality of holes 11 for emitting sound provided in a circle. A magnet 3 is fixed on an inner plane of the cover 1 such that the center axis of the cover 1 passes through the center of the magnet 3. A disc-like diaphragm 4 is provided within the casing 20 so as to provide space G between a lower surface of the magnet 3 and the diaphragm 4. The diaphragm 4 is secured at its outer circumferential portion sandwiched between the cover 1 and the frame 2. A drive coil 5 is fixed on a lower surface of the diaphragm 4 so as to have the same center axis as the center axis of the magnet 3. An electrode 6 for applying an electric current to the drive coil 5 is fixed on the bottom of the frame 2. A lead line (not shown) extending from the drive coil 5 is connected to an end of the electrode 6.

In the conventional electroacoustic transducer illustrated in FIG. 16, the magnet 3 emits magnetic fluxes from its lower surface, such that magnetic fluxes emitted from the vicinity of the center of the magnet 3 pass substantially perpendicularly through the drive coil 5, while magnetic fluxes emitted from an outer circumferential portion of the magnet 3 radiate from the lower surface of the magnet 3 so as to pass diagonally through the drive coil 5. In a magnetic field formed by emission of the above-described magnetic fluxes, when an electric current is applied to the drive coil 5, a drive force in a direction perpendicular to the diaphragm 4 is generated in the drive coil 5. Such a drive force causes the diaphragm 4 to vibrate up and down, thereby producing sound. The conventional electroacoustic transducer illustrated in FIG. 16 is configured to emit magnetic fluxes directly from the magnet 3. Accordingly, this conventional electroacoustic transducer requires neither a yoke nor a center pole, and therefore the entire thickness thereof can be reduced. Moreover, the drive coil 5 has a high degree of freedom in the range of possible winding widths, and therefore has a high degree of freedom in the range of possible impedance values. Accordingly, by increasing the impedance of the drive coil 5, it is made possible to achieve reduction in power consumption of the conventional electroacoustic transducer.

Further, in the conventional electroacoustic transducer illustrated in FIG. 16, the drive force generated in the drive coil 5 increases in proportion to the intensity of magnetic fluxes perpendicular to a direction of the electric current flowing through the drive coil 5 and a vibration direction of the diaphragm 4. In FIG. 16, magnetic fluxes parallel to the vibration direction of the diaphragm 4 are dominant over the magnetic fluxes perpendicular to the vibration direction of the diaphragm 4. Accordingly, the conventional electroacoustic transducer illustrated in FIG. 16 is not able to obtain a satisfactory drive force, and therefore is able to provide only a low reproduced sound pressure.

Furthermore, the intensity of the magnetic fluxes emitted from the magnet 3 decreases in proportion to the distance from the magnet 3. Accordingly, the drive force generated in the drive coil 5 varies between the case where the diaphragm 4 is located in a downward direction from its initial position as shown in FIG. 16 (i.e., a direction away from the magnet 3) and the case where the diaphragm 4 is located in an upward direction from its initial position (i.e., a direction toward the magnet 3). Such a variation of the drive force causes distortion of the drive force in the conventional electroacoustic transducer illustrated in FIG. 16, resulting in deterioration of reproduced sound.

SUMMARY OF THE INVENTION

Therefore, an object of the present invention is to provide an electroacoustic transducer capable of highly efficiently reproducing high quality sound, and an electronic apparatus using such an electroacoustic transducer.

The present invention has the following features to attain the object mentioned above.

A first aspect of the present invention is directed to an electroacoustic transducer which includes: a diaphragm; a casing; a drive coil; a first magnetic structure; and a second magnetic structure. The casing supports the diaphragm. The drive coil is provided on the diaphragm. The first magnetic structure has a first space in a center thereof provided within the casing such that a center axis, which is a straight line perpendicular to a plane of the diaphragm, passes through a center of the drive coil and penetrates the first space. The second magnetic structure has a second space in a center thereof provided within the casing on a side opposed to the first magnetic structure with respect to the diaphragm, such that the center axis penetrates the second space. In this case, the first magnetic structure is oriented such that a magnetization direction thereof is parallel to the center axis, and the second magnetic structure is oriented such that a magnetization direction thereof is opposite to that of the first magnetic structure.

Each of the first and second magnetic structures may have a ring-like shape, and may be placed such that the center axis passes through a center thereof.

Alternatively, the first and second magnetic structures may have a same columnar external shape. In this case, the drive coil has a circular shape and is located where a line perpendicular to an outer circumference of the first magnetic structure projects onto the diaphragm.

When the first and second magnetic structures have a same columnar external shape, the drive coil may have a circular shape and may be located where a line perpendicular to an inner circumference of the first magnetic structure projects onto the diaphragm.

Alternatively, when the first and second magnetic structures have a same columnar external shape, the drive coil may include: a circular inner circumference coil; and a circular outer circumference coil provided outside of the circular inner circumference coil and having a winding direction opposite to that of the circular inner circumference coil.

Further, the circular inner circumference coil may be located where a line perpendicular to an inner edge of the first magnetic structure projects onto the diaphragm, and the circular outer circumference coil may be located where a line perpendicular to an outer edge of the first magnetic structure projects onto the diaphragm.

Furthermore, the first magnetic structure may include two magnet pieces opposed to each other with respect to the center axis and may have the first space provided between the two magnet pieces. In this case, the two magnet pieces included in the first magnetic structure are arranged such that their magnetization directions are the same as each other. The second magnetic structure includes two magnet pieces opposed to the two magnet pieces included in the first magnetic structure with respect to the diaphragm, the two magnet pieces included in the second magnetic structure are opposed to each other with respect to the center axis, and the second magnetic structure has the second space provided between the two magnet pieces. The two magnet pieces included in the second magnetic structure are arranged such that their magnetization directions are the same as each other.

Alternatively, the two magnet pieces included in each of the first and second magnetic structures may have a same rectangular solid-like shape. In this case, the drive coil has a rectangular shape, and opposing portions of the drive coil parallel to the two magnet pieces included in the first magnetic structure are located where lines perpendicular to outer edges of the two magnet pieces included in the first magnetic structure project onto the diaphragm. Note that the "outer edges of the two magnet pieces included in the first magnetic structure" correspond to edges of the first magnetic structure which are located on the far side from the center axis in a cross section of the electroacoustic transducer which includes the first magnetic structure and the center axis. Specifically, in the later-described FIG. 1A, the "outer edges of the two magnet pieces included in the first magnetic structure" correspond to edges 420 and 421.

When the magnet pieces included in each of the first and second magnetic structures have a same rectangular solid-like shape, the drive coil may have a rectangular shape, and opposing portions of the drive coil parallel to the two magnet pieces included in the first magnetic structure may be located where lines perpendicular to inner edges of the two magnet pieces included in the first magnetic structure projects onto the diaphragm.

Alternatively, when the magnet pieces included in each of the first and second magnetic structures have a same rectangular solid-like shape, the drive coil may include: a rectangular inner circumference coil; and a rectangular outer circumference coil provided outside of the rectangular inner circumference coil and having a winding direction opposite to that of the rectangular inner circumference coil.

Further, the rectangular inner circumference coil may be located where lines perpendicular to inner edges of the two magnet pieces included in the first magnetic structure project onto the diaphragm, and the rectangular outer circumference coil may be located where lines perpendicular to outer edges of the two magnet pieces included in the first magnetic structure project onto the diaphragm.

Furthermore, it is preferred that the drive coil is located where an absolute value of the density of magnetic fluxes generated on the plane of the diaphragm by the first and second magnetic structures is maximized. Note that the wording "absolute value of the density of magnetic fluxes" as described herein refers to an absolute value of the size of a magnetic flux density component in a direction perpendicular to a vibration direction of the diaphragm.

A second aspect of the present invention is directed to an electroacoustic transducer which includes: a diaphragm; a casing; a drive coil; a first magnetic structure; and a second magnetic structure. The casing supports the diaphragm. The drive coil is provided on the diaphragm. The first magnetic structure has a first space in a center thereof provided within the casing such that a center axis, which is a straight line perpendicular to a plane of the diaphragm, passes through a center of the drive coil and penetrates the first space. The second magnetic structure has a second space in a center thereof provided within the casing on a side opposite to the first magnetic structure with respect to the diaphragm, such that the center axis penetrates the second space. In this case, the first magnetic structure is magnetized such that a magnetization direction thereof is perpendicular to the center axis, and senses of the magnetization direction are symmetric to each other with respect to one of the center axis and a cross section which includes the center axis. The second magnetic structure has a same magnetization direction as that of the first magnetic structure.

Note that each of the first and second magnetic structures may have a radially magnetized ring-like shape and is placed such that the center axis passes through a center thereof.

Alternatively, the first magnetic structure may include two magnet pieces opposed to each other with respect to the center axis and may have the first space provided between the two magnet pieces. In this case, the two magnet pieces included in the first magnetic structure are arranged such that their magnetization directions are opposite to each other. The second magnetic structure includes two magnet pieces opposed to the two magnet pieces included in the first magnetic structure with respect to the diaphragm, the two magnet pieces included in the second magnetic structure are opposed to each other with respect to the center axis, and the second magnetic structure has the second space provided between the two magnet pieces. The two magnet pieces included in the second magnetic structure are arranged such that their magnetization directions are opposite to each other.

In the first and second aspects, the first and second magnetic structures may have a same shape and structure.

Further, the diaphragm typically has a shape of one of a circle, an oval, and a rectangle.

Furthermore, the casing typically has a shape of one of a column, an elliptic cylinder, and a rectangular solid.

The electroacoustic transducer may further include: a first yoke provided on at least a part of a periphery of the first magnetic structure; and a second yoke provided on at least a part of a periphery of the second magnetic structure.

Further, a gap may be provided between a portion of the first magnetic structure and a portion of the first yoke, and a gap may be provided between a portion of the second magnetic structure and a portion of the second yoke.

Furthermore, the first and second yokes may be integrally formed with a part of the casing.

The drive coil typically has a shape of one of a circle, an oval, and a rectangle.

Further, the drive coil may be integrally formed with the diaphragm.

Furthermore, the drive coil may be formed on opposite faces of the diaphragm.

The casing typically has at least one hole.

The present invention may provide an electronic apparatus including an electroacoustic transducer according to the first or second aspect.

Thus, in the first and second aspects, two magnets, i.e., the first and second magnetic structures, are provided on opposite sides of the diaphragm, so that magnetic components in a direction perpendicular to the direction of vibration of the diaphragm are dominant among magnetic flux vectors on the plane of the diaphragm. Accordingly, it is possible to realize a highly efficient electroacoustic transducer in which the drive force generated in the drive coil is increased as compared to the conventional electroacoustic transducer as shown in FIG. 16. Moreover, by providing the two magnetic structures on opposite sides of the diaphragm, it is made possible to overcome the asymmetry of the drive force during vibration of the diaphragm, and thus it is possible to realize an electroacoustic transducer capable of reproducing high quality sound.

Further, in the first aspect, each of the first and second magnetic structures is structured to have a space in a center thereof, and therefore it is possible to improve the magnetic operating point as compared to a magnet having a shape without a space in a center thereof (e.g., a coin-shaped magnet), i.e., it is possible to increase a magnetic permeance coefficient. For example, consider a magnet having a ring-like shape which is typical of the structure having a space in a center thereof. The permeance coefficient of a ring-shaped magnet having an outer diameter of 9.6 mm is three and half times the permeance coefficient of a coin-shaped magnet having the same outer diameter as the outer diameter of the ring-shaped magnet.

In the case where the first magnetic structure is ring-shaped, when a circular drive coil is provided in the location where a line perpendicular to an outer circumference of the first magnetic structure projects onto the diaphragm, the magnetic flux density is high in the location where the drive coil is provided. Accordingly, a high drive force is generated in the drive coil, and therefore it is possible to achieve an effect of enhancing the level of reproduced sound pressure of the electroacoustic transducer. The same effect can be achieved by providing the circular drive coil in the location where a line perpendicular to an inner circumference of the first magnetic structure projects onto the diaphragm.

Alternatively, in the case where each of the first and second magnets is formed by two rectangular solid-like magnet pieces, when opposing portions of the drive coil parallel to the two magnet pieces included in the first magnetic structure are located where lines perpendicular to outer edges of the two magnet pieces included in the first magnetic structure project onto the diaphragm, a high drive force is generated in the drive coil, and therefore it is possible to achieve an effect of enhancing the level of reproduced sound pressure of the electroacoustic transducer. The same effect can be achieved by providing the first magnetic structure such that the opposing portions of the drive coil parallel to the two magnetic pieces included in the first magnetic structure are located where lines perpendicular to inner edges of the two magnet pieces included in the first magnetic structure project onto the diaphragm.

Alternatively, when the drive coil includes two coils, i.e., the inner and outer circumference coils, it is possible to enhance the level of reproduced sound pressure of the electroacoustic transducer. Moreover, by providing the two coils in optimum locations, it is made possible to further enhance the level of reproduced sound pressure of the electroacoustic transducer.

Thus, it is preferred that the drive coil is provided in the location where the absolute value of the density of magnetic fluxes generated on the plane of the diaphragm generated by the first and second magnetic structures is maximized. By providing the drive coil in such a location, it is made possible to enhance the level of reproduced sound pressure of the electroacoustic transducer.

In the second aspect, the first and second magnetic structures are magnetized in a direction perpendicular to the center axis, and therefore it is possible to provide uniform magnetic flux density in the vicinity of the locations where the shapes of the magnets are projected onto the diaphragm. In this case, the degree of freedom in designing the location of the drive coil is increased as compared to the first aspect. In the second aspect, the magnetic operating point, i.e., the permeance coefficient, is substantially the same as that of the first aspect, and therefore the magnetic operating point of the second aspect is improved as compared to the conventional electroacoustic transducer as shown in FIG. 16.

Further, by providing the yoke in the electroacoustic transducer, the magnetic fluxes emitted from the magnets are concentrated by the yoke, thereby increasing the drive force generated in the drive coil.

Furthermore, by integrally forming the yoke with a part of the casing, it is possible to reduce the number of assembly parts of the electroacoustic transducer.

Further still, by integrally forming the drive coil with the diaphragm, it is possible to prevent the breakage of the drive coil which is a typical problem of winding coils. Moreover, when the drive coil is integrally formed with the diaphragm, it is not necessary to bond the diaphragm and the drive coil together or to connect lead wires during the production of the electroacoustic transducer, leading to easy production of the electroacoustic transducer. For example, it is made possible to easily provide a dual structured drive coil which is not easily realized by a conventional winding coil.

In the electroacoustic transducer as described above, the magnetic operating point can be improved, and therefore the electroacoustic transducer can operate even when the thickness of each magnet is reduced as compared to the conventional electroacoustic transducer as shown in FIG. 16. Accordingly, it is possible to reduce the thickness of the electroacoustic transducer itself, and therefore when the electroacoustic transducer according to the first or second aspect of the present invention is used in an electronic apparatus, such as a mobile telephone, a PDA, a television set, a personal computer, and a car navigation system, it is possible to provide the electronic apparatus in a more compact size.

These and other objects, features, aspects and advantages of the present invention will become more apparent from the following detailed description of the present invention when taken in conjunction with the accompanying drawings.

DESCRIPTION OF THE PREFERRED EMBODIMENTS

First Embodiment

Figure 1A:
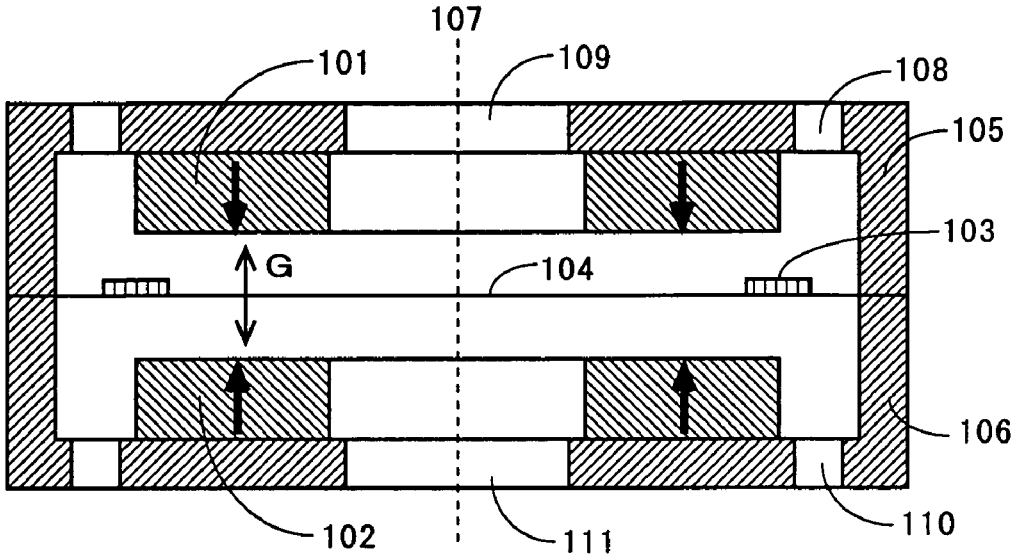
FIG. 1A is a cross-sectional view of an electrical acoustic transducer according to a first embodiment of the present invention.
Figure 1B:
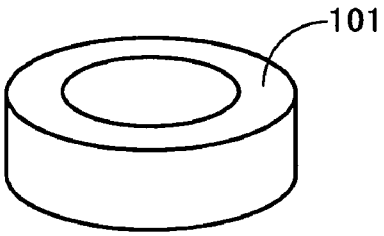
FIG. 1B is a perspective view of a magnet used in the electroacoustic transducer according to the first embodiment.
Figure 1C:
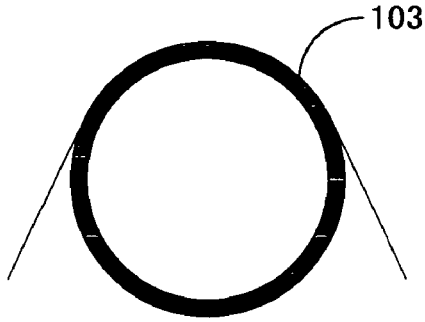
FIG. 1C is a top view of a drive coil used in the electroacoustic transducer according to the first embodiment.
Figure 1D:
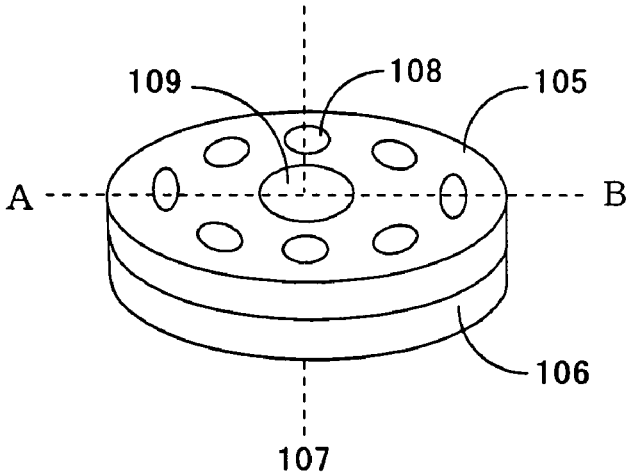
FIG. 1D is a perspective view of the electroacoustic transducer according to the first embodiment.
Figure 2:
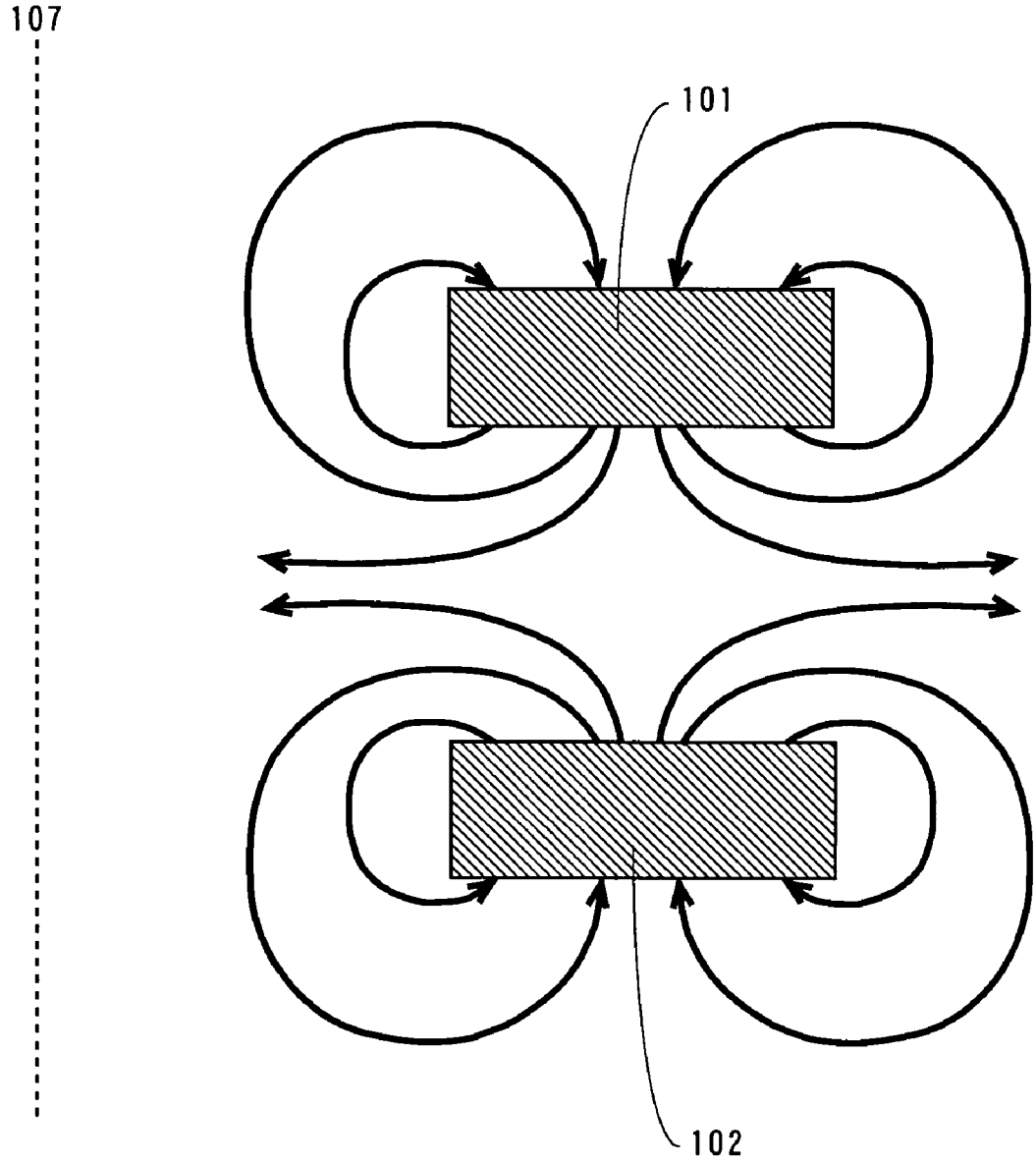
FIG. 2 is a diagram showing magnetic flux vectors generated by first and second magnets shown in FIG. 1A.
Figure 3:
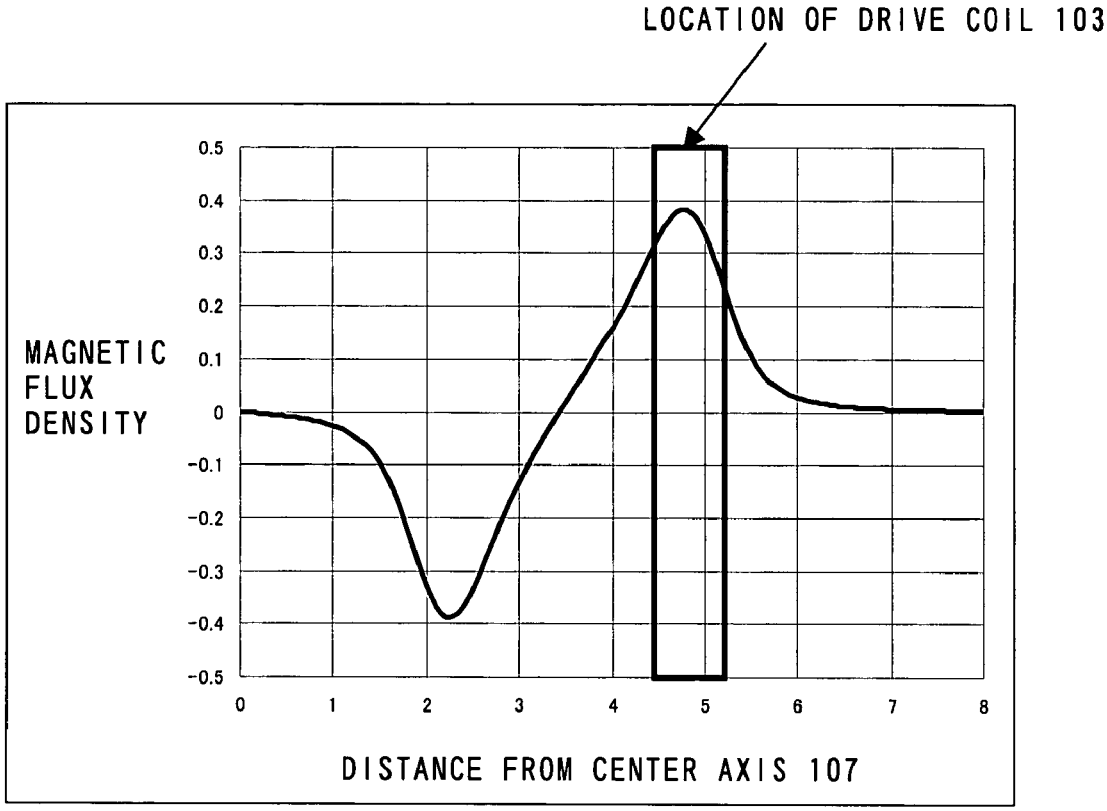
FIG. 3 is a graph showing the relationship between the magnetic flux density and the distance in the radial direction from a center axis on a plane of a diaphragm shown in FIG. 1A.
Figure 4A:
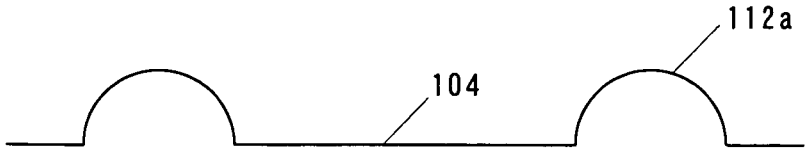
FIGS. 4A through 4D are diagrams each showing a variation of a diaphragm 104 in the first embodiment.
Figure 4B:
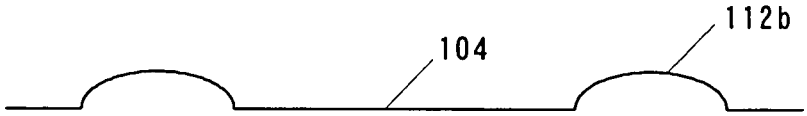
Figure 4C:
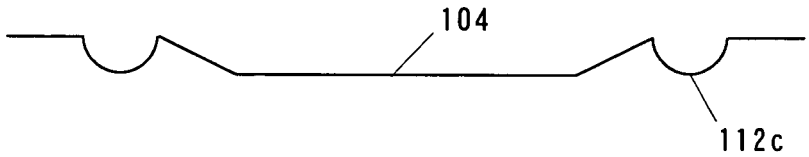
Figure 4D:
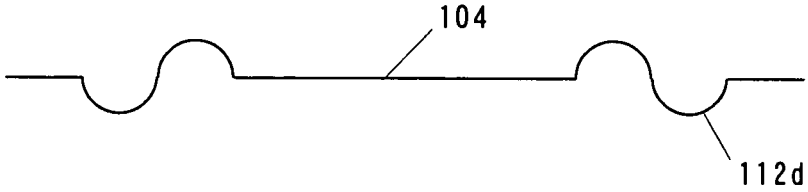

An electroacoustic transducer according to a first embodiment of the present invention will now be described. FIGS. 1A through 1D are views used for explaining the structure of the electroacoustic transducer according to the first embodiment. Specifically, FIG. 1A is a cross-sectional view of the electrical acoustic transducer, FIG. 1B is a perspective view of a first magnet used in the electroacoustic transducer, FIG. 1C is a top view of a drive coil used in the electroacoustic transducer, and FIG. 1D is a perspective view of the electroacoustic transducer. FIG. 2 is a diagram showing magnetic flux vectors generated by first and second magnets shown in FIG. 1A. FIG. 3 is a graph showing the relationship between the magnetic flux density and the distance in the radial direction from the center axis on a plane of a diaphragm shown in FIG. 1A.

In FIG. 1A, a cross section of the electroacoustic transducer taken along line A-B of FIG. 1D is shown. The electroacoustic transducer illustrated in FIG. 1A includes: a first magnet 101; a second magnet 102; a drive coil 103; a diaphragm 104; and cases 105 and 106.

Each of the cases 105 and 106 is formed of anon-magnetic substance, e.g., a resin material such as polycarbonate (PC). AS can be seen from FIGS. 1A and 1D, the case 105 has a circular shape and is open on one end. The case 105 includes an air hole 109 at the center of the surface on the other end. Air holes 108 are provided around the air hole 109. The air holes 108 and 109 are provided for emitting sound. The case 106 has the same structure as that of the case 105, and includes air holes 110 and 111 corresponding to the air holes 108 and 109, respectively. The cases 105 and 106 are joined to each other at the open end. Within the thus-joined cases 105 and 106, there are provided the first and second magnets 101 and 102, the drive coil 103, and the diaphragm 104. Hereinafter, two joined cases such as the cases 105 and 106 are also collectively referred to as a "casing" in order to simplify the description.

As shown in FIG. 1B, the first magnet 101 is ring-shaped, and has a rectangular cross section. Specifically, the first magnet 101 has a columnar external shape with a columnar hollow having a center axis corresponding to the center axis of the columnar first magnet 101. As described above, the first magnet 101 is shaped so as to have a space in its central portion. By shaping the first magnet 101 so as to have a space in its central portion, it is made possible to increase the ratio of vertical to horizontal lengths of a magnet cross section parallel to a magnetization direction of the first magnet 101 (i.e., the vertical direction indicated by downward arrows in FIG. 1A), as compared to a magnet without a space in its central portion (e.g., the columnar magnet shown in FIG. 16), whereby it is possible to improve the magnetic operating point, i.e., it is possible to increase a magnetic permeance coefficient. Although not shown in FIG. 1B, the second magnet 102 has the same shape as that of the first magnet 101 illustrated in FIG. 1B. For example, each of the first and second magnets 101 and 102 is formed by a neodymium magnet having an energy product of 39 mega gauss oersteds (MGOe).

Referring to FIG. 1C, the drive coil 103 is of a circular type with a predetermined radius. The radius of the drive coil 103 is approximately equal to an outer radius of each of the first and second magnets 101 and 102. The details of the drive coil 103 will be described later.

Referring to FIG. 1A, the first magnet 101 is fixed on the case 105 such that both the center axis of the first magnet 101 and the center axis of the case 105 correspond to a center axis 107. The center axis 107 passes through the center of the columnar electroacoustic transducer illustrated in FIG. 1D. The second magnet 102 is fixed on the case 106 such that both the center axis of the second magnet 102 and the center axis of the case 106 correspond to the center axis 107. The drive coil 103 is provided on the diaphragm 104 so as to be concentric to each of the first and second magnets 101 and 102, i.e., the center of the driver coil 103 corresponds to the center axis 107. In the first embodiment, the drive coil 103 is glued to the diaphragm 104. For example, the drive coil 103 is glued on a surface of the diaphragm 104 having a circular shape. The diaphragm 104 is secured at its outer circumferential portion sandwiched between the cases 105 and 106, such that the drive coil 103 is located in the middle between the first and second magnets 101 and 102. In this manner, the first and second magnets 101 and 102, the drive coil 103, the diaphragm 104, and the cases 105 and 106 are provided such that the center axis 107 passes through their respective centers.

As described above, the diaphragm 104 is secured at its outer circumferential portion by the cases 105 and 106 having the same shape. Accordingly, the drive coil 103 provided on the surface of the diaphragm 104 is held so as to be located in the middle between the first and second magnets 101 and 102. In other words, the drive coil 103 is provided on a plane located in an equal distance from each of the first and second magnets 101 and 102 (i.e., a plane on which the diaphragm 104 is provided). Accordingly, when an electric signal is applied to the drive coil 103, the force applied to the drive coil 103 from the magnetic field generated by the first magnet 101 is equivalent to the force applied to the drive coil 103 from the magnetic field generated by the second magnet 102.

In the first embodiment, the magnetization direction of each of the first and second magnets 101 and 102 corresponds to a vertical direction of a ring-like shape, i.e., an upward or downward direction indicated by a bold arrow shown in FIG. 1A. The first and second magnets 101 and 102 are fixed such that their magnetization directions are opposite to each other. For example, when the first magnet 101 is magnetized downwardly, i.e., in a direction from the first magnet 101 toward the second magnet 102, the second magnet 102 is magnetized upwardly, i.e., in a direction from the second magnet 102 toward the first magnet 101 (see bold arrows shown in FIG. 1A). As described above, the two ring-shaped magnets 101 and 102 are provided so as to be opposed to each other with respect to the diaphragm 104 and magnetized in a direction perpendicular to the diaphragm 104 such that each of the two magnets 101 and 102 has a magnetization direction opposite to the magnetization direction of the other one.

When no electric signal is applied to the drive coil 103, the first and second magnets 101 and 102 magnetized as shown in FIG. 1A generate magnetic fluxes as illustrated in FIG. 2. Since the first and second magnets 101 and 102 have opposite magnetization directions, repulsion occurs between magnetic fluxes emitted by the first and second magnets 101 and 102, so that magnetic flux vectors curve substantially perpendicularly in the vicinity of the middle between the first and second magnets 101 and 102. As a result, in the vicinity of the location where the diaphragm 104 and the drive coil 103 are provided, which corresponds to the vicinity of the middle between the first and second magnets 101 and 102, there is generated a magnetic field formed by magnetic fluxes perpendicular to a vibration direction of the diaphragm 104 (i.e., the direction of the center axis 107 shown in FIG. 1A). Since each of the first and second magnets 101 and 102 is ring-shaped, the direction of magnetic flux vectors on the inner circumference side of the first and second magnets 101 and 102 (the side close to the center axis 107, i.e., the left side of FIG. 2) is opposite to the direction of magnetic flux vectors on the outer circumference side of the first and second magnets 101 and 102 (the side far from the center axis 107, i.e., the right side of FIG. 2).

The graph of FIG. 3 shows the relationship between the magnetic flux density and the distance in the radial direction from the center axis 107 on the plane of the diaphragm when a static magnetic field as shown in FIG. 2 is generated. In the first embodiment, each of the first and second magnets 101 and 102 is ring-shaped, and therefore as shown in FIG. 3, the absolute value of the magnetic flux density is maximized at the location distanced about 2 mm or about 5 mm from the center axis 107. Specifically, the magnetic flux density is minimized at a distance of about 2 mm from the center axis 107 and is maximized at a distance of about 5 mm from the center axis 107. In order for the drive coil 103 to generate a drive force most efficiently, it is preferred that the drive coil 103 is provided at the location where the absolute value of the magnetic flux density is maximized in the magnetic flux density distribution as shown in FIG. 3. Accordingly, in the first embodiment, the drive coil 103 is provided in a location within the framed range shown in FIG. 3 which includes a location at a distance of 5 mm from the center axis 107.

The absolute value of the magnetic flux density is maximized in the vicinity of the location where the outer circumference of the first magnet 101 is projected onto the diaphragm, and also maximized in the vicinity of the location where the inner edge of the first magnet 101 is projected onto the diaphragm. Accordingly, in the first embodiment, the drive coil 103 is provided in the location where the outer circumference of the first magnet 101 is projected onto the diaphragm. Referring to FIG. 1A, the location of the drive coil 103 includes a perpendicular line which can be drawn between the outer circumferences of the first and second magnets 101 and 102. Specifically, the drive coil 103 is provided such that the center axis 107 passes through the center of the drive coil 103, and the drive coil 103 has an outer radius which is larger than the outer radiuses of the first and second magnets 101 and 102. Moreover, the drive coil 103 has an inner radius which is smaller than the outer radiuses of the first and second magnets 101 and 102.

Described next is the operation of the thus-structured electroacoustic transducer when an alternating electric signal is applied to the drive coil 103. When the alternating electric signal is applied to the drive coil 103, a drive force is generated so as to be in proportion to the intensity of magnetic fluxes perpendicular to a direction of an electric current flowing through the drive coil 103 and a vibration direction of the diaphragm 104. The diaphragm 104 having the drive coil 103 glued thereon is caused to vibrate by the drive force, and vibration of the diaphragm 104 is emitted as sound.

As is apparent from FIG. 2, in the vicinity of the location where the drive coil 103 is provided, magnetic fluxes perpendicular to the direction of the electric current flowing through the drive coil 103 and the vibration direction of the diaphragm 104 are dominant among the magnetic fluxes emitted by the first and second magnets 101 and 102. Moreover, as described in conjunction with FIG. 3, the drive coil 103 is present in the location where the absolute value of the magnetic flux density is maximized. Accordingly, the drive force of the drive coil 103 is increased as compared to the drive force of the drive coil used in the conventional electroacoustic transducer shown in FIG. 16. Thus, the electroacoustic transducer according to the first embodiment is able to provide a high level of reproduced sound pressure.

Figure 16:
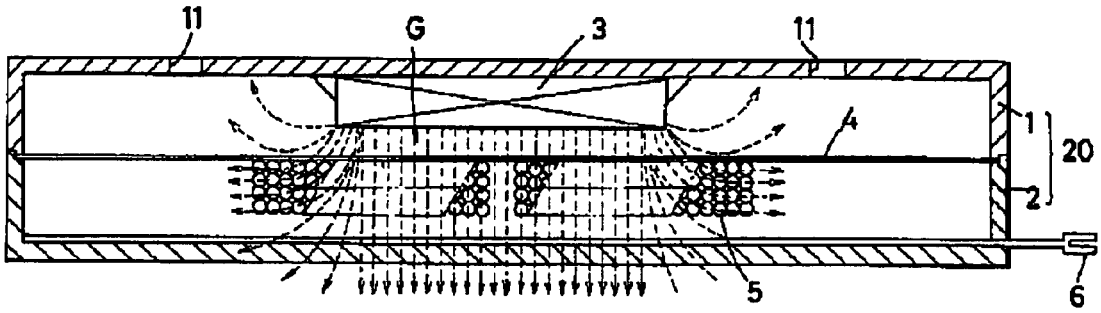
FIG. 16 PRIOR ART
FIG. 16 illustrates the structure of a conventional electroacoustic transducer.

In the conventional electroacoustic transducer shown in FIG. 16, the magnet 3 has a coin-like shape, and therefore when attempting reduction in thickness of the magnet 3 in order to reduce the entire thickness of the conventional electroacoustic transducer, the operating point of the magnet 3 is lowered, making it difficult to efficiently utilize the magnet 3. On the other hand, in the first embodiment, each of the first and second magnets 101 and 102 is ring-shaped, and therefore it is possible to prevent the magnetic operating point from being lowered even if the thickness of each magnet is reduced. For example, when the diameter of each magnet is about 9.6 mm, the permeance coefficient of a ring-shaped magnet is three and half times the permeance coefficient of a coin-shaped magnet. Accordingly, the electroacoustic transducer according to the first embodiment is more heat resistant than the conventional electroacoustic transducer shown in FIG. 16, and is able to operate in a higher temperature environment.

Further, the conventional electroacoustic transducer shown in FIG. 16 includes only one magnet 3, and therefore when the diaphragm 4 vibrates, the magnetic flux density varies depending on the distance between the diaphragm 4 and the magnet 3. Specifically, the magnetic flux density increases as the diaphragm 4 moves closer to the magnet 3, while the magnetic flux density decreases as the diaphragm 4 moves away from the magnet 3. Accordingly, when the diaphragm 4 vibrates, the drive force generated in the drive coil 5 is asymmetric between near and far sides of the magnet 3 with respect to the center of vibration, i.e., the location of the diaphragm 4 generating no vibrations. Such asymmetry of the drive force causes secondary distortion, resulting in deterioration of sound quality. On the other hand, in the first embodiment, the first and second magnets 101 and 102 are provided so as to be vertically symmetric to each other with respect to the drive coil 103, and therefore when the diaphragm 104 vibrates, the drive force generated in the drive coil 103 is symmetric between near and far sides of the magnet 3 with respect to the center of vibration. Accordingly, in the first embodiment, the secondary distortion is reduced by employing a magnetic circuit structure using two magnets, i.e., the first and second magnets 101 and 102, whereby it is possible to enhance the sound quality.

In the first embodiment, although the drive coil 103 has been described as being provided in the location where the outer circumference of the first magnet 101 is projected onto the diaphragm 104 (see FIG. 1A), the drive coil 103 may be provided in the location where the inner edge of the first magnet 101 is projected onto the diaphragm 104. In the vicinity of such a location, the absolute value of the magnetic flux density is also maximized (see FIG. 3), and therefore the drive coil 103 is able to generate as high a drive force as the drive force generated in the case described in conjunction with FIG. 1. Moreover, by providing the drive coil 103 in the location on which the inner edge of the first magnet 101 is projected onto the diaphragm 104, it is made possible to reduce the interior diameter of the casing so as to be equivalent to the outer diameters of the first and second magnets 101 and 102, whereby it is possible to reduce the size of the electroacoustic transducer.

Further, in the first embodiment, although each of the first and second magnets 101 and 102 has been described as being a neodymium magnet, a ferrite magnet or a samarium-cobalt magnet may be used in accordance with a target sound pressure level or the shape of each of the first and second magnets 101 and 102. As in the case of the first embodiment, magnets used in the later-described second through fifth embodiments may be formed of any material.

Furthermore, in the first embodiment, although the diaphragm 104 shown in FIG. 1A has been described as having flat surfaces, the diaphragm 104 may have edge portions as shown in FIGS. 4A through 4D. FIGS. 4A through 4D are cross-sectional views showing variations of the diaphragm 104 according to the first embodiment. The edge portions are provided so as to satisfy requirements for both a desired minimum resonance frequency and a desired maximum amplitude of vibration of the diaphragm 104. Examples of a cross section of an edge portion include a semicircle- or arc-shaped cross section 112*a* shown in FIG. 4A, a semioval-shaped cross section 112*b* shown in FIG. 4B, a cross section 112*c* shown in FIG. 4C, and a wave-shaped cross section shown in FIG. 4D. As in the case of the first embodiment, diaphragms used in the later-described second through fifth embodiments may have any cross-sectional shape.

Further still, in the first embodiment, although each of the cases 105 and 106 has been described as being formed of a non-magnetic material, a magnetic material may be used. By using a magnetic material, it is made possible to reduce leakage of magnetic fluxes from the first and second magnets 101 and 102 toward the casing.

Further still, in the first embodiment, although each of the first and second magnets 101 and 102 has been described as having a columnar external shape, each of them may have another external shape, such as an elliptic cylinder-like shape and a rectangular solid-like shape, depending on the external shape of the electroacoustic transducer. In the cases of external shapes other than the columnar external shape, the diaphragm 104 may be shaped in accordance with the external shape of the magnets. That is, when each of the first and second magnets 101 and 102 has an elliptic cylinder-like shape, the diaphragm 104 may have an oval-like shape, and when each of the first and second magnets 101 and 102 has a rectangular solid-like shape, the diaphragm 104 may have a rectangular shape.

It should be noted that in the first embodiment, unlike an internal magnet-type loudspeaker, it is not necessary to place the drive coil within a magnetic gap formed between a magnet and a yoke. Accordingly, the drive coil is only required to be present in a space between the first and second magnets 101 and 102, and therefore it is not necessary to realize a uniform winding width of the drive coil 103. In general, for reasons of production technique, there is a difficulty in providing a drive coil, which is generally formed by winding a copper wire, in such a shape as to have a high aspect ratio (e.g., an oval or rectangular shape) as compared to a circular drive coil. In particular, in the case of a drive coil shaped so as to have a high aspect ratio, it is difficult to realize a uniform winding width. On the other hand, in the first embodiment, the drive coil 103 is not required to have a uniform winding width, and therefore the drive coil 103 can be readily shaped so as to have a high aspect ratio. Accordingly, the first embodiment provides a high degree of freedom in designing the drive coil 103, and therefore it is possible to readily realize an electroacoustic transducer having an elongated shape.

Further, in the first embodiment, by providing at least one sound hole in at least one of top, bottom, and side faces of a casing, it is made possible to prevent the minimum resonance frequency from rising due to influences of air chambers formed by a diaphragm and the casing. In the first embodiment, although the air holes have been described as being provided only in the top and bottom faces of the casing, the air holes may be provided in the side faces of the casing so as to emit reproduced sound therefrom. Moreover, a vibration damping cloth may be provided over the air holes in order to control the Q factor of the minimum resonance frequency. Similar to the first embodiment, in the later-described second through fifth embodiments, the air holes may be provided in any locations of the casing, and the vibration damping cloth may be provided over the air holes.

Second Embodiment

Figure 5:
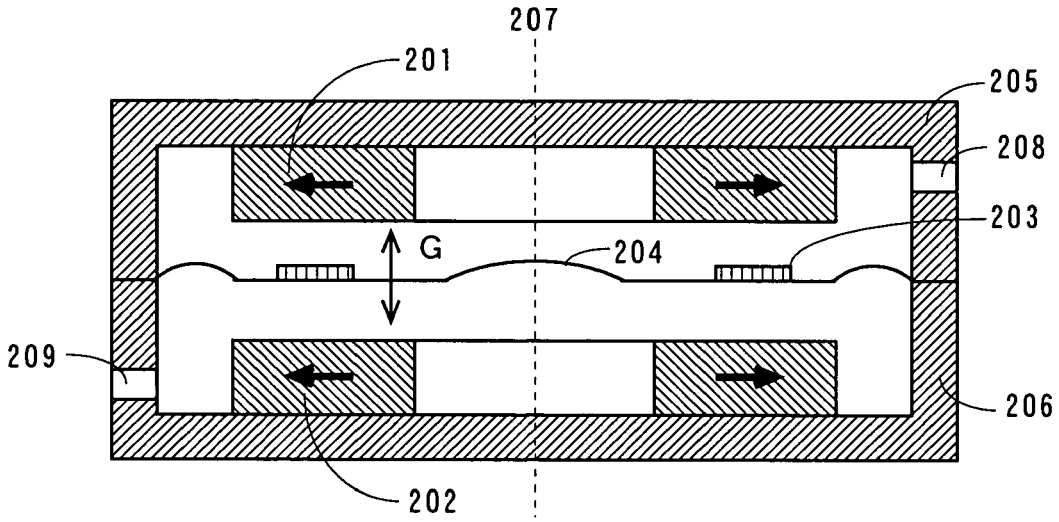
FIG. 5 is a cross-sectional view of an electroacoustic transducer according to a second embodiment of the present invention.
Figure 6:
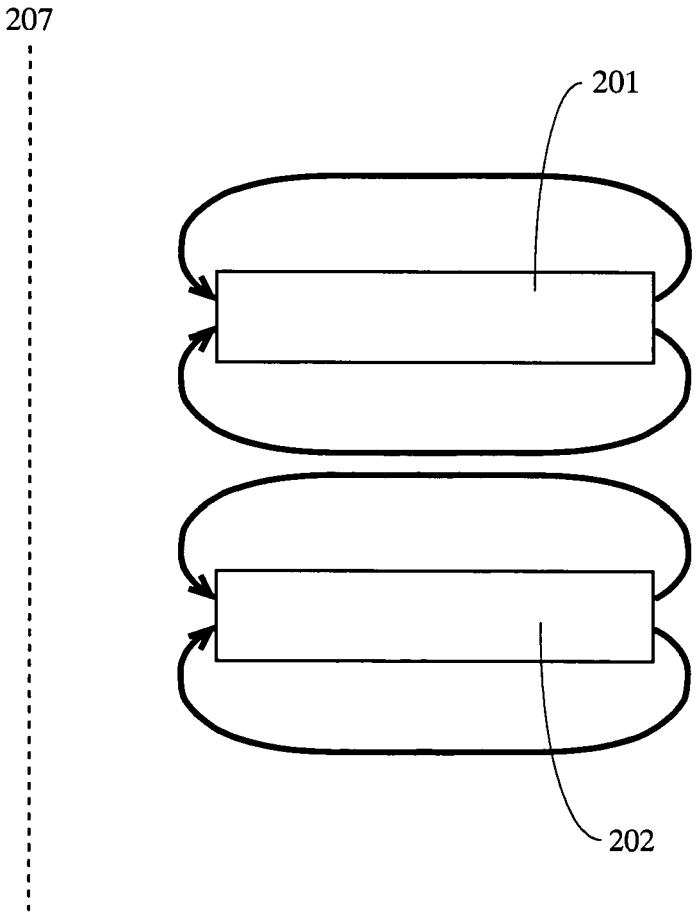
FIG. 6 is a diagram showing magnetic flux vectors generated by magnets in the second embodiment.

An electroacoustic transducer according to a second embodiment of the present invention will now be described with reference to FIGS. 5 and 6. FIG. 5 is a cross-sectional view of the electroacoustic transducer according to the second embodiment. FIG. 6 is a diagram showing magnetic flux vectors generated by magnets included in the electroacoustic transducer according to the second embodiment. The external appearance of the electroacoustic transducer according to the second embodiment is the same as the external appearance of the electroacoustic transducer according to the first embodiment except for locations of air holes.

The cross-sectional view of FIG. 5 shows a cross section of the electroacoustic transducer having a columnar shape which is taken along a center axis 207 passing through the center of the electroacoustic transducer. The electroacoustic transducer illustrated in FIG. 5 includes: a first magnet 201; a second magnet 202; a drive coil 203; a diaphragm 204; and cases 205 and 206. The shape of the electroacoustic transducer according to the second embodiment is similar to the shape of the electroacoustic transducer according to the first embodiment except for the following first through third differences. Hereinbelow, the first through third differences between the first and second embodiments are described.

The first difference is that the diaphragm 204 is not flat-shaped, and has arc- or semicircle-shaped cross sections in a central portion and an outer circumferential portion. Specifically, the diaphragm 204 has arc-shaped cross-sections on the inner and outer circumferential sides of the drive coil 203 glued on the diaphragm 204. By forming the diaphragm 204 so as to have such arc-shaped cross-sections, it is made possible to allow the diaphragm 204 to have large vibration amplitude as compared to a flat-shaped diaphragm. Moreover, it is possible to increase the stiffness of the central portion of the diaphragm 204. The second difference is that an air hole 208 is provided in a side face of the case 205, and an air hole 209 is provided in a side face of the case 206. This allows the electroacoustic transducer according to the second embodiment to be placed in an electronic apparatus so as to face a direction different from the direction the electroacoustic transducer according to the first embodiment can face.

The third difference is that each of the first and second magnets 201 and 202 has a magnetization direction different from the magnetization direction of each of the first and second magnets 101 and 102. As shown in FIG. 5, each of the first and second magnets 201 and 202 is magnetized in a direction from the ring center to the outer edge, i.e., the radial direction (as indicated by bold arrows in FIG. 5), (hereinafter, such magnetization is referred to as "radial magnetization"). Note that the direction of the radial magnetization may be a direction from the inner to outer circumferences of the ring-shaped magnets or may be a direction from the outer to inner circumferences of the ring-shaped magnet, so long as the magnetization directions of the first and second magnets 201 and 202 are the same as each other.

Described next is the operation of the thus-structured electroacoustic transducer. As in the case of the first embodiment, a magnetic field is formed in the vicinity of the drive coil 203 by the first and second magnets 201 and 202, and therefore a drive force is generated when an alternating electric signal is applied to the drive coil 203. The diaphragm 204 having the drive coil 203 glued thereon is caused to vibrate by the drive force, and vibration of the diaphragm 204 is emitted as sound. The operation of the second embodiment is similar to that of the first embodiment with respect to the above points.

The magnetic flux vectors generated by the first and second magnets 201 and 202 radially magnetized as described above are as shown in FIG. 6. In the second embodiment, the first and second magnets 201 and 202 positioned above or below the diaphragm 204 have undergone the radial magnetization, such that the polarities in their inner circumferential portions are identical to each other and the polarities in their outer circumferential portions are identical to each other. Accordingly, repulsion occurs between magnetic fluxes emitted from the first and second magnets 201 and 202, resulting in a magnetic field as shown in FIG. 6, where magnetic field components in the radial direction are dominant in a magnetic gap G as indicated by a double-headed arrow in FIG. 5.

In the second embodiment, since the magnetic field is formed such that the magnetic components in the radial direction are dominant, the magnetic flux density is uniformly high in a space between a perpendicular line, which can be drawn between the inner edges of the first and second magnets 201 and 202, and another perpendicular line, which can be drawn between the outer circumferences of the first and second magnets 201 and 202. Accordingly, in the second embodiment, the magnetic flux density and the distance in the radial direction from the center axis 207 passing through the center of the magnetic gap G are in a relationship such that the magnetic flux is high in a wide range from the inner to outer circumferences of the first and second magnets 201 and 202. Specifically, on a plane of the diaphragm 204, the magnetic flux density is high within an annular area having inner and outer circumferences which are equal to the inner and outer circumferences, respectively, of each of the first and second magnets 201 and 202. Moreover, the magnetic flux density is uniform in such an annular area on the plane of the diaphragm 204. Note that the "plane of the diaphragm" refers to a flat planar portion of the diaphragm 204 and does not refer to portions other than the flat planar portion, e.g., portions having arc-shaped cross sections.

In the above-described first embodiment, the magnetization direction of each of the magnets 101 and 102 is the direction toward the center axis of the ring shape (i.e., the direction toward the center axis 107 of FIG. 1A), and therefore the magnetic flux density is high in each of the inner and outer circumferential portions of the magnets 101 and 102, and low in the other portions of the magnets 101 and 102 (see FIG. 3). On the other hand, in the second embodiment, the magnetic flux density is uniformly high within the range from the inner to outer circumferences of the magnets 201 and 202. Accordingly, in the second embodiment, the drive coil 203 can be provided over a wide area as compared to the first embodiment. Thus, it is possible to increase, for example, the number of turns and the length of the drive coil 203 as compared to the first embodiment, thereby increasing the drive force of the drive coil 203. Moreover, since the magnetic flux density is distributed substantially uniformly, a magnetic flux density variation, which depends on the location of the drive coil 203, is reduced in the vibration direction. Accordingly, it is possible to minimize unevenness in sound pressure level among electroacoustic transducers which is caused during assembly. As described above, the drive coil 203 can be provided over a wide area as compared to the first embodiment, and therefore there is a high degree of freedom in designing the shapes of the drive coil 203 and the diaphragm 204.

It should be noted that in the second embodiment, the first magnet 201 is realized by radially magnetizing one mass of magnet. In other embodiments, radial magnetization may be implemented by reuniting divided magnets after magnetizing them. The second magnet 202 may be radially magnetized in a manner similar to the first magnet 201.

Third Embodiment

Figure 7A:
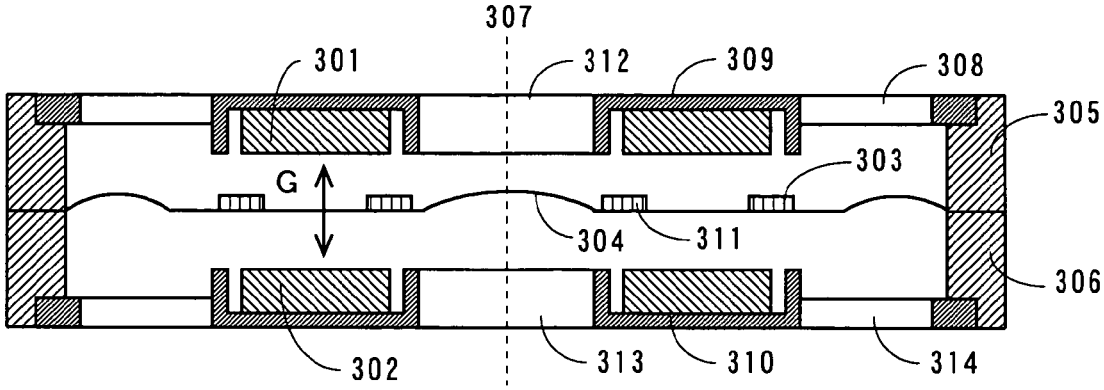
FIG. 7A is a cross-sectional view of an electroacoustic transducer according to a third embodiment of the present invention.
Figure 7B:
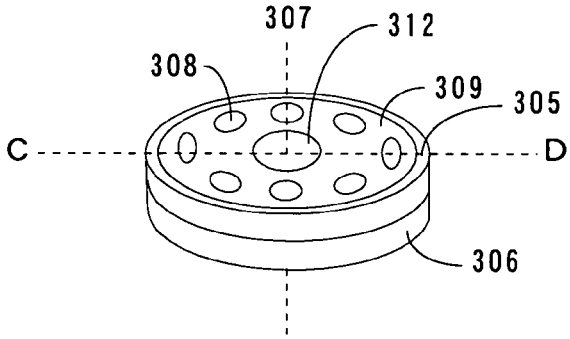
FIG. 7B is a perspective view of the electroacoustic transducer according to the third embodiment.
Figure 7C:
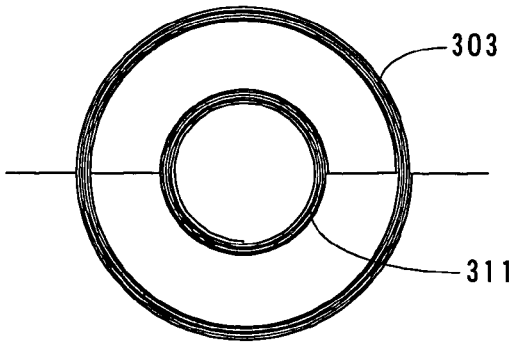
FIG. 7C is a top view of a drive coil included in the electroacoustic transducer according to the third embodiment.
Figure 8:
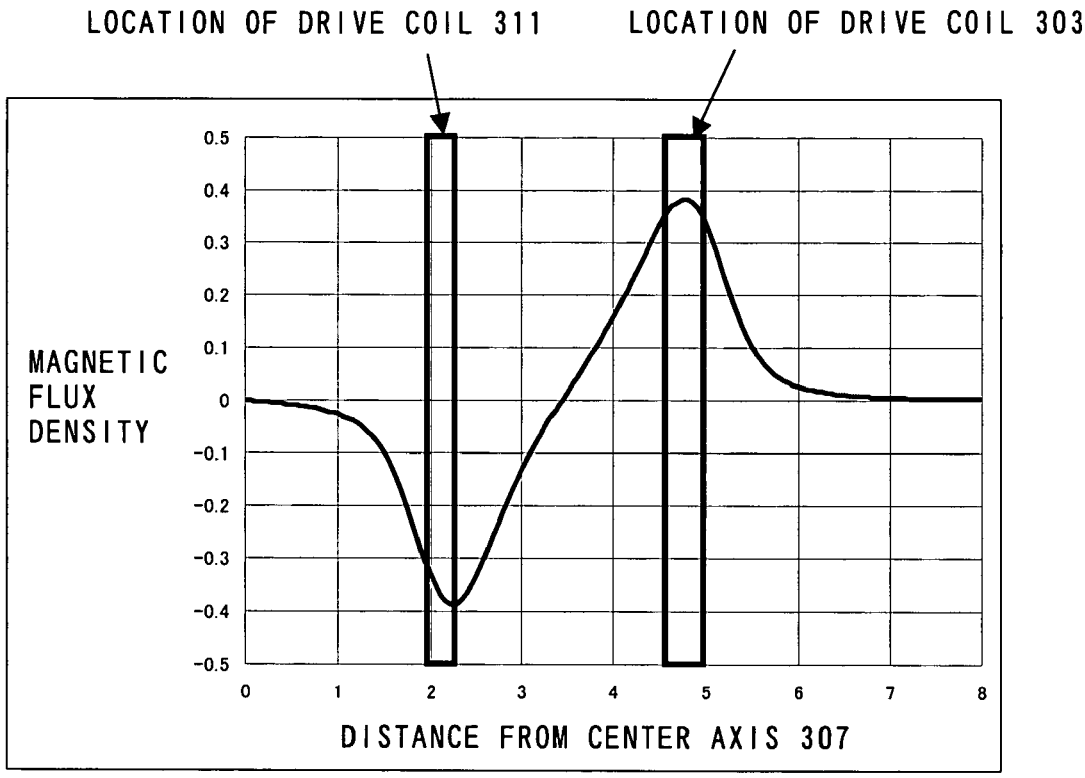
FIG. 8 is a graph showing the relationship between the magnetic flux density and the distance in the radial direction from a center axis on a plane of a diaphragm shown in FIG. 7A.

An electroacoustic transducer according to a third embodiment of the present invention will now be described. FIGS. 7A through 7C are views used for explaining the structure of the electroacoustic transducer according to the third embodiment. Specifically, FIG. 7A is a cross-sectional view of the electroacoustic transducer according to the third embodiment, FIG. 7B is a perspective view of the electroacoustic transducer according to the third embodiment, and FIG. 7C is a top view of a drive coil included in the electroacoustic transducer according to the third embodiment. FIG. 8 is a graph showing the relationship between the magnetic flux density and the distance in the radial direction from a center axis on a plane of a diaphragm shown in FIG. 7A. FIGS. 9A through 9E are views each showing a relationship between a magnet and a yoke according to the third embodiment.

In FIG. 7A, a cross section of the electroacoustic transducer taken along line C-D of in FIG. 7B is shown. The electroacoustic transducer illustrated in FIG. 7A includes: a first magnet 301; a second magnet 302; a first drive coil 303; a second drive coil 311; a diaphragm 304; cases 305 and 306; a first yoke 309; and a second yoke 310. The first and second magnets 301 and 302 are the same as the first and second magnets 101 and 102 described in the first embodiment. The diaphragm 304 is the same as the diaphragm 204 described in the second embodiment. The electroacoustic transducer shown in FIG. 7A is the same as the electroacoustic transducers described in the first and second embodiments except for the following first and second differences.

The first difference is that, as can be seen from FIGS. 7A and 7B, the first yoke 309 is provided so as to surround the first magnet 301, and the second yoke 310 is provided so as to surround the second magnet 302. Each of the first and second yokes 309 and 310 is formed of, for example, a magnetic material such as iron. The case 305 is joined to the outer circumference of the first yoke 309, and the case 306 is joined to the outer circumference of the second yoke 310. The first yoke 309 includes air holes 308 and 312 for emitting sound. Similarly, the second yoke 310 includes air holes 313 and 314.

The second difference is that, as can be seen from FIG. 7C, the electroacoustic transducer according to the third embodiment has a dual coil structure in which two drive coils, i.e., the first and second drive coils 303 and 311, are provided such that the first drive coil 303 is positioned so as to surround the second drive coil 311. Specifically, the first drive coil 303 is provided in a location where the outer circumference of the first magnet 301 is projected onto the diaphragm 304, and the second drive coil 311 is provided in a location where the inner edge of the first magnet 301 is projected onto the diaphragm 304. In other words, the first drive coil 303 having a radius substantially equal to an outer radius of each of the first and second magnets 301 and 302 is provided on a plane of the diaphragm 304, and the second drive coil 311 having a radius substantially equal to an inner radius of each of the first and second magnets 301 and 302 is provided on the plane of the diaphragm 304. The winding direction of the first drive coil 303 is opposite to the winding direction of the second drive coil 311.

Described next is the operation of the thus-structured electroacoustic transducer. A magnetic field is generated by the first and second magnets 301 and 302 and the first and second yokes 309 and 310. As in the case of the first embodiment, this magnetic field is formed by magnetic fluxes perpendicular to the vibration direction of the diaphragm 304. The graph of FIG. 8 shows the relationship between the magnetic flux density and the distance in the radial direction from a center axis 307 on the plane of the diaphragm 304 when the above-described magnetic field is generated. In order for each of the first and second drive coils 303 and 311 to generate a drive force most efficiently, each of them is provided at a location where the absolute value of the magnetic flux density is maximized in the magnetic flux density distribution shown in FIG. 8. Accordingly, as is apparent from FIG. 7A, the first drive coil 303 is provided in a location through which a perpendicular line which can be drawn between the outer circumferences of the magnets 301 and 302 passes, and the second drive coil 311 is provided in a location through which a perpendicular line which can be drawn between the inner edges of the magnets 301 and 302 passes. When an alternating electric signal is applied to each of the first and second drive coils 303 and 311 provided in the locations as described above, a drive force is generated in each of the first and second drive coils 303 and 311. Such drive forces cause the diaphragm 304 having the first and second drive coils 303 and 311 glued thereon to vibrate, thereby emitting sound. Note that the direction of an electric current flowing through the drive coil 303 is opposite to the direction of an electric current flowing through the drive coil 311.

In the electroacoustic transducer according to the third embodiment having the first and second yokes 309 and 310, a magnetic path is formed by the first magnet 301 and the first yoke 309, and another magnetic path is formed by the second magnet 302 and the second yoke 310. Accordingly, magnetic fluxes emitted from the first magnet 301 is guided to the magnetic gap G by the first yoke 309, and magnetic fluxes emitted from the second magnet 311 is guided to the magnetic gap G by the second yoke 310, so that the magnetic flux density in the magnetic gap G is increased. As a result, in the magnetic gap G, the magnetic flux density is increased in the locations where the first and second drive coils 303 and 311 are provided, and therefore the drive force generated in each of the drive coils 303 and 311 is increased in proportion to the magnetic flux density, thereby enhancing the level of reproduced sound pressure. Further, the provision of the first and second yokes 309 and 310 reduces leakage of magnetic fluxes to the outside of the electroacoustic transducer.

In this manner, by providing the first and second yokes 309 and 310 so as to surround the first and second magnets 301 and 302, respectively, the magnetic fluxes emitted from the first and second magnets 301 and 302 are concentrated in the first and second yokes 309 and 310, thereby increasing the drive force generated in each of the first and second drive coils 303 and 311. Further, by providing the two drive coils 303 and 311 in the locations where the magnetic flux density is maximized, it is made possible to increase the total drive force to cause the diaphragm 304 to vibrate. Furthermore, since the diaphragm 304 is driven by the drive coils 303 and 311 placed in different locations, it is easy to control modes of vibration generated during vibration of the diaphragm 304.

Figure 9A:
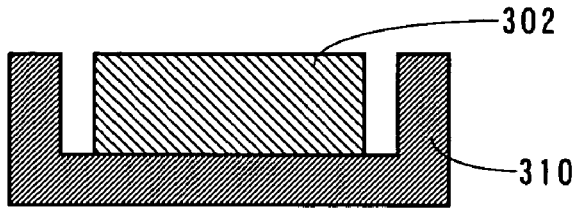
FIGS. 9A through 9E are views each showing a relationship between a magnet and a yoke in the third embodiment.
Figure 9B:
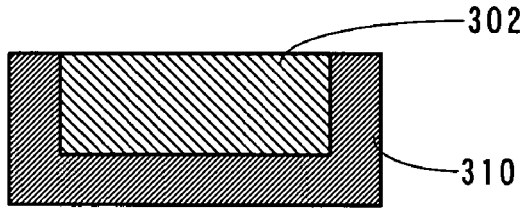
Figure 9C:
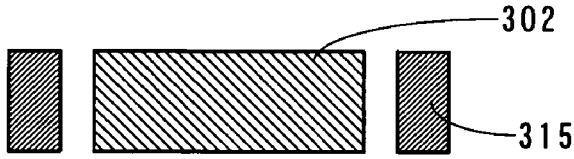
Figure 9D:
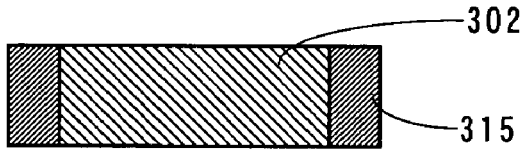
Figure 9E:
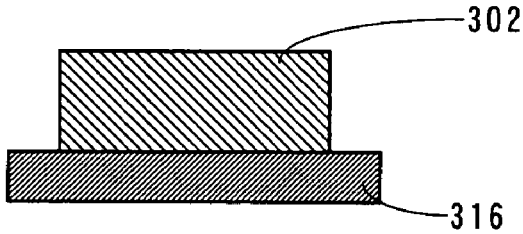

In the third embodiment, slits are provided between the inner side faces of the first yoke 309 and the side faces of the first magnet 301, and slits are also provided between the inner side faces of the second yoke 310 and the side faces of the second magnet 302. Each of the first and second yokes 309 and 310 shown in FIG. 7A may be provided in the form as shown in FIGS. 9A through 9E. FIG. 9A illustrates the structure of the second yoke 310 shown in FIG. 7A. FIGS. 9B through 9E illustrate variations of the second yoke 310 shown in FIG. 7A. The second yoke 310 may be structured as shown in FIG. 9B in order to reduce the outside diameter of the electroacoustic transducer or increase the arc-shaped cross-sectional area in the outer circumferential portion of the diaphragm 304. In the structure shown in FIG. 9B, no slits are provided, and the side faces of the second magnet 302 are in close contact with the inner side faces of the second yoke 310. Alternatively, as shown in FIG. 9C, a ring-shaped yoke 315 may be provided so as to cover only the side faces of the second magnet 302, or as shown in FIG. 9D, the yoke 315 may be provided so as to be in close contact with the side faces of the second magnet 302. Alternatively still, as shown in FIG. 9E, a disc-like yoke 316 may be provided on the bottom face of the second magnet 302. Note that in the case where each of the first and second magnets 301 and 302 has a rectangular solid-like shape, yokes are not required to entirely cover the side faces of the first and second magnets 301 and 302, and therefore may be provided so as to partially cover the side faces of the first and second magnets 301 and 302. Although FIGS. 9A through 9E illustrate the exemplary structures of the second yoke 310, the first yoke 309 can also be structured in a variety of manners as shown in FIGS. 9A through 9E.

In the case where the electroacoustic transducer includes the yokes as described above, it is preferred that the drive coils 303 and 311 are positioned inside the outer circumferences of the yokes. Specifically, in FIG. 7A, the drive coil 303 is preferably positioned in the location including perpendicular lines, which can be drawn between the outer circumferences of the first and second magnets 301 and 302, without crossing perpendicular lines which can be drawn between the outer circumferences of the first and second yokes 309 and 310 (i.e., the drive coil 303 is positioned on the side closer to the center axis 307 with respect to each of such lines between the outer circumferences of the first and second yokes 309 and 310).

In the third embodiment, the electroacoustic transducer includes two drive coils, i.e., the first and second drive coils 303 and 311. However, in other embodiments, the electroacoustic transducer may include only one of the first drive coil 303 and the second drive coil 311. Specifically, the electroacoustic transducer as described in the first embodiment may include the first and second yokes 309 and 310 as described in the third embodiment. Note that in the case where the yokes do not cover the side faces of the magnets (see FIG. 9E), when the electroacoustic transducer includes only one drive coil, e.g., the second drive coil 311, it is possible to lengthen the magnets to the length of the inner diameter of the casing.

Although the electroacoustic transducer according to the third embodiment has been described as including the yokes, no yokes may be included. Specifically, the electroacoustic transducer as described in the first embodiment may include the first and second drive coils 303 and 311 as described in the third embodiment. Even in such a case, it is possible to increase the total drive force to cause the diaphragm 304 to vibrate. Further, since the diaphragm 304 is driven by the two drive coils placed in different locations, it is easy to control modes of vibration generated during vibration of the diaphragm 304. Note that it is preferred that each drive coil is provided in a location where the absolute value of the magnetic flux density is maximized. The direction of magnetic fluxes on the diaphragm changes in the center between the outer and inner edges of each magnet. Specifically, in the example of FIGS. 2 and 3, magnetic fluxes on the diaphragm are directed outward on the outside of the center between the outer and inner edges, and inward on the inside of the center. In the case where the magnetization direction of the magnet is opposite to the magnetization direction in the example of FIGS. 2 and 3, the magnetic fluxes on the diaphragm are directed inward on the outside of the center between the outer and inner edges, and outward on the inside of the center. Accordingly, in the case of using two drive coils having opposite winding directions, a drive coil on the outer circumferential side is located outside the center between the outer and inner edges, and another coil on the inner circumferential side is located inside the center.

Note that in the third embodiment, the yokes are formed of a material different from the material of the casing to which they are joined. However, the yokes may be formed by a magnetic material so as to be integrated with the casing, in order to reduce the number of assembly parts of the electroacoustic transducer.

Fourth Embodiment

Figure 10A:
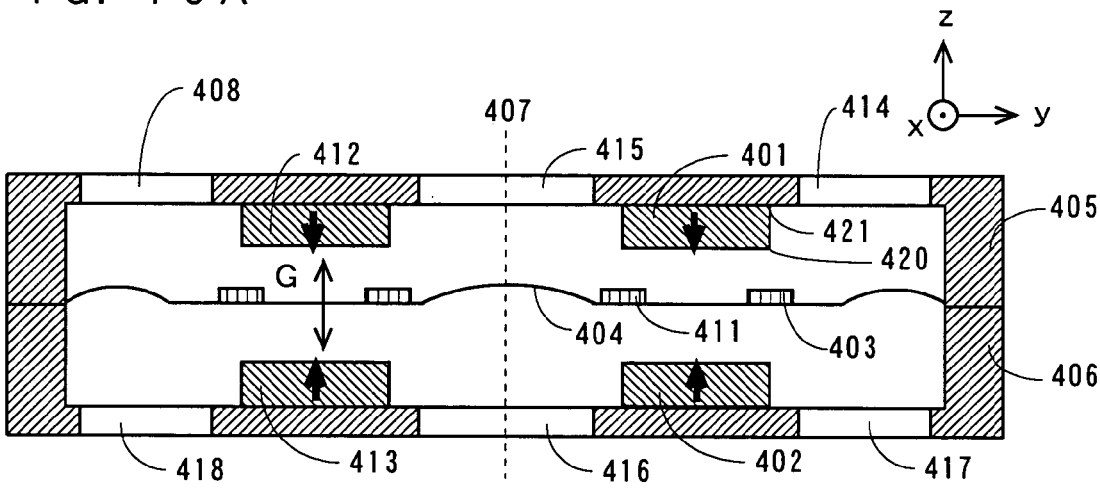
FIG. 10A is a cross-sectional view of an electroacoustic transducer according to a fourth embodiment of the present invention.
Figure 10B:
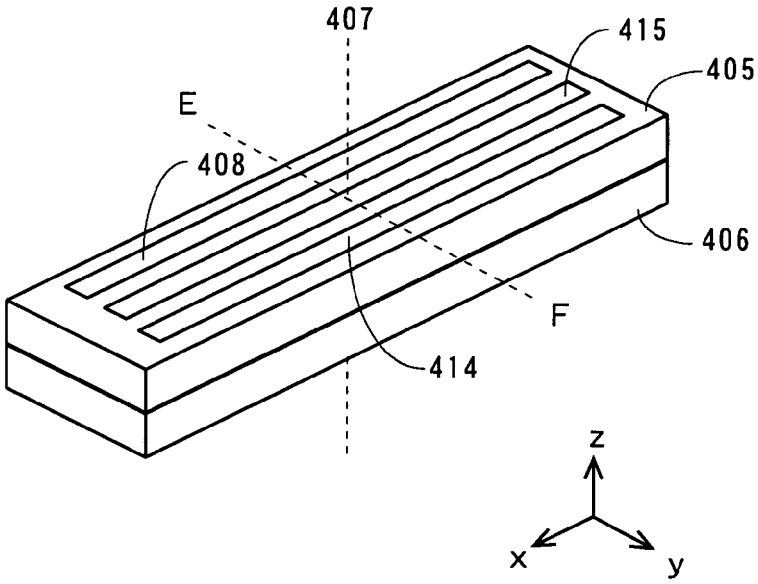
FIG. 10B is a perspective view of the electroacoustic transducer according the fourth embodiment.
Figure 11A:
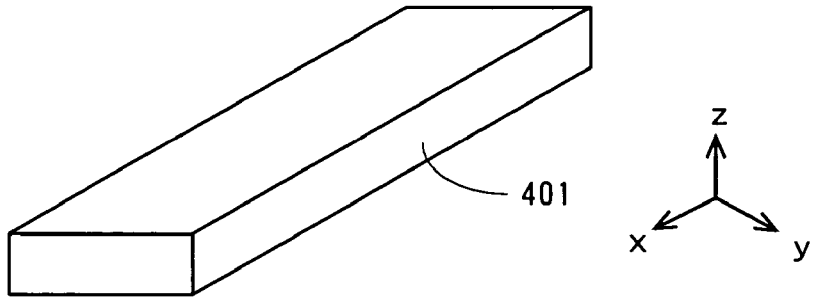
FIG. 11A is a perspective view of the electroacoustic transducer according to the fourth embodiment.
Figure 11B:
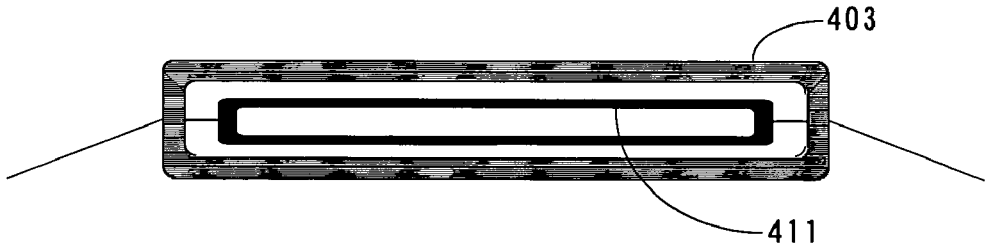
FIG. 11B is a top view of a drive coil included in the electroacoustic transducer according to the fourth embodiment.
Figure 11C:
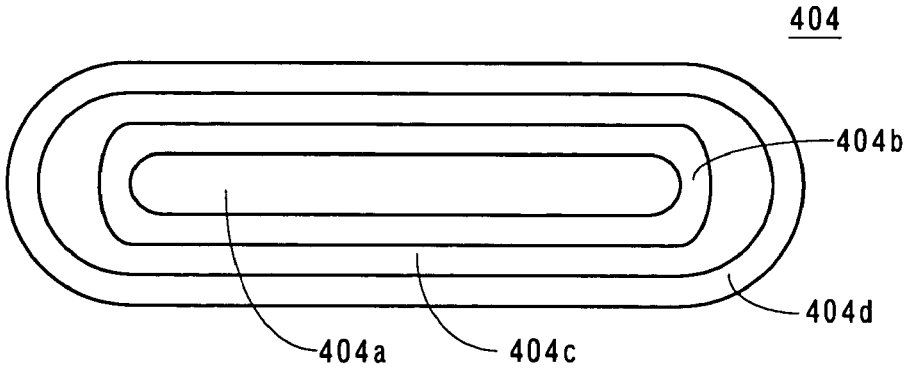
FIG. 11C is a top view of a diaphragm included in the electroacoustic transducer according to the fourth embodiment.

An electroacoustic transducer according to a fourth embodiment of the present invention will now be described. FIGS. 10A and 10B are views used for explaining the structure of the electroacoustic transducer according to the fourth embodiment. Specifically, FIG. 10A is a cross-sectional view of the electroacoustic transducer according to the fourth embodiment. FIG. 10B is a perspective view of the electroacoustic transducer according the fourth embodiment. FIGS. 11A through 11C are views illustrating a magnet, drive coils, and a diaphragm, respectively, included in the electroacoustic transducer according to the fourth embodiment. Specifically, FIG. 11A is a perspective view of a magnet 401, FIG. 11B is a top view showing first and second drive coils 403 and 411, and FIG. 11C is a top view of a diaphragm 404.

In FIG. 10A, a cross section of the electroacoustic transducer taken along line E-F of FIG. 10B is shown. The electroacoustic transducer illustrated in FIG. 10A includes: the first magnet 401; a second magnet 402; a third magnet 412; a fourth magnet 414; the first drive coil 403; the second drive coil 411; the diaphragm 404; and cases 405 and 406. Note that a center axis 407 shown in FIG. 10A is a straight line parallel to the z-axis shown in FIG. 10B which passes through the center of the electroacoustic transducer.

The electroacoustic transducer according to the fourth embodiment differs from the electroacoustic transducer according to the first embodiment in that the electroacoustic transducer according to the fourth embodiment has a rectangular solid-like external shape. In accordance with such a difference of the external shape, each of the diaphragm 404, the first and second drive coils 403 and 411, and the first through fourth magnets 401, 402, 412, and 413 has a shape different from a corresponding element of the electroacoustic transducer according to the third embodiment.

As can be seen from FIGS. 10A and 10B, the case 405 has a rectangular solid-like shape and is open on one end. On another end opposed to the open end, an air hole 415 is provided in a central portion, and air holes 408 and 414 are provided on opposite sides of the air hole 415. The air holes 408, 414, and 415 are provided for emitting sound. The case 406 has a structure similar to that of the case 405, and includes air holes 416, 417, and 418. The cases 405 and 406 are joined to each other at the open ends. Note that each of the cases 405 and 406 is formed of a non-magnetic material, e.g., a resin material such as PC.

As shown in FIG. 11A, the first magnet 401 has a rectangular solid-like shape. Each of the second through fourth magnets 402, 412, and 413 has the same shape as that of the first magnet 401 as shown in FIG. 11A. The first through fourth magnets 401, 402, 412, and 413 have the same magnetization direction as each other. In FIG. 11A, each of the first through fourth magnets 401, 402, 412, and 413 is magnetized in the z-axis direction. Hereinafter, a direction of the longest side among sides of each magnet is referred to as the "longitudinal direction". In FIG. 11A, the x-axis direction corresponds to the longitudinal direction.

The first through fourth magnets 401, 402, 412, and 413 are positioned such that their longitudinal directions are parallel to each other. The first magnet 401 is fixed on a portion of the case 405 between the air holes 414 and 415. The second magnet 402 is positioned so as to be opposed to the first magnet 401 with respect to the diaphragm 404. Specifically, the second magnet 402 is fixed on a portion of the case 406 between the air holes 416 and 417. The third magnet 412 is fixed on a portion of the case 405 between the air holes 408 and 415. The fourth magnet 413 is positioned so as to be opposed to the third magnet 412 with respect to the diaphragm 404. Specifically, the fourth magnet 413 is fixed on a portion of the case 406 between the air holes 416 and 418. The first and third magnets 401 and 412 are provided so as to be symmetric to each other with respect to the center axis 407. Similarly, the second and fourth magnets 402 and 413 are provided so as to be symmetric to each other with respect to the center axis 407.

The first through fourth magnets 401, 402, 412, and 413 are arranged such that their magnetization directions are parallel to the vibration direction of the diaphragm 404. Specifically, the first and third magnets 401 and 412 have the same magnetization direction as each other, and the second and fourth magnets 402 and 413 have the same magnetization direction as each other. The magnetization direction of the first and third magnets 401 and 412 is opposite to the magnetization direction of the second and fourth magnets 402 and 413. For example, when the first and third magnets 401 and 412 are magnetized downwardly, i.e., in a direction from the first magnet 401 toward the second magnet 402, the second and fourth magnets 402 and 413 are magnetized upwardly, i.e., in a direction from the second magnet 402 toward the first magnet 401 (see bold arrows shown in FIG. 10A).

As described above, in the fourth embodiment, two magnet pieces, i.e., the first and third magnets 401 and 412, are used instead of using the first magnet 101 as described in the first embodiment, and the second and fourth magnets 402 and 413 are used instead of using the second magnet 102 as described in the first embodiment. In the fourth embodiment, a space is provided between a pair of magnets opposed to each other with respect to the center axis 407 (i.e., the first and third magnets 401 and 412 have a space therebetween, and the second and fourth magnets 402 and 413 have a space therebetween). Note that such a pair of magnets are also correctively referred to as a "magnetic structure". The concept of the magnetic structure includes a structure formed by one magnet as in the case of the first magnet 101 described in the first embodiment. By providing a space between such a pair of magnets, it is made possible to increase the ratio between horizontal and vertical lengths of a magnet cross section parallel to the magnetization direction of the magnets (i.e., the vertical direction indicated by downward arrows in FIG. 10A), as compared to a magnet without the space, whereby it is possible to improve the magnetic operating point. A rectangular solid-shaped magnet as obtained by joining the first and third magnets 401 and 412 together is one conceivable example of a magnet without the space.

As shown in FIG. 11B, each of the drive coils 403 and 411 has a rectangular shape. Similar to the third embodiment, the electroacoustic transducer according to the fourth embodiment has a dual coil structure in which the first drive coil 403 is positioned so as to surround the second drive coil 411. The first and second drive coils 403 and 411 are provided on the diaphragm 404 such that their longitudinal directions are parallel to the longitudinal directions of the first through fourth magnets 401, 402, 412, and 413, and the center axis 407 passes through the center of the first and second drive coils 403 and 411. The first and second drive coils 403 and 411 are glued on the diaphragm 404.

Each of the first and second drive coils 403 and 411 is provided in a location where the absolute value of the magnetic flux density is maximized on the plane of the diaphragm 404. Referring to FIG. 10A, the first drive coil 403 is provided such that two opposing edges of the rectangular shape of the first drive coil 403 are present in the location where the outer circumference of the first or third magnet 401 or 412 is projected onto the diaphragm 404. The "outer circumference of the first magnet 401" refers to an edge of the first magnet 401 which is located on the far side from the center axis 407 in a cross section of the electroacoustic transducer which includes the first magnet 401 and the center axis 407. Specifically, in FIG. 10A, the outer circumference of the first magnet 401 refers to an edge 420 or 421. In the fourth embodiment, the "two opposing edges" correspond to two longer edges among four edges of the rectangular shape of the first drive coil 403 (see FIG. 11B). The drive coil 411 is provided such that two opposing edges of the rectangular shape of the drive coil 411 are present in the location where the inner edge of the first or third magnet 401 or 412 is projected onto the diaphragm 404.

Referring to FIGS. 10A and 11B, the first drive coil 403 is positioned such that a perpendicular line, which can be drawn between outer sides of the first and second magnets 401 and 402, passes through one of two length sides of the first drive coil 403, and another perpendicular line, which can be drawn between outer sides of the third and fourth magnets 412 and 413, passes through the other length side of the first drive coil 403. Here, an outer side of a magnet is used to mean a side (or a plane) of the magnet which is located on the far side from the center axis 407. On the other hand, the second drive coil 411 is positioned such that a perpendicular line, which can be drawn between inner sides of the first and second magnets 401 and 402, passes through one of two length sides of the second drive coil 411, and another perpendicular line, which can be drawn between inner sides of the third and fourth magnets 412 and 413, passes through the other length side of the second drive coil 411. Here, an inner side of a magnet is used to mean a side (or a plane) of the magnet which is located on the near side to the center axis 407.

As shown in FIG. 1C, the diaphragm 404 has an oval-like shape when viewed from above. As shown in FIG. 10A, the diaphragm 404 includes first and second arc portions 404*a* and 404*c* each having an arc-shaped cross section. The diaphragm 404 also includes a portion 404*b* between the first and second arc portions 404*a* and 404*c*, and a portion 404*d* on the outer circumferential side of the second arc portion 404*c*. Each of the portions 404*b* and 404*d* has a flat cross section. The first and second drive coils 403 and 411 are provided in the portion 404*b*.

As can be seen from FIG. 10A, the portion 404*d* of the diaphragm 404 is sandwiched between the cases 405 and 406 such that the diaphragm 404 is secured. In this case, the portion 404*d* of the diaphragm 404 is positioned such that each of the first and second drive coils 403 and 411 is equally distanced from the first and second magnets 401 and 402, as well as from the third and fourth magnets 412 and 413.

Described next is the operation of the thus-structured electroacoustic transducer. A magnetic field is generated by the first through fourth magnets 401, 402, 412, and 413. As in the case of the first embodiment, this magnetic field is formed by magnetic fluxes perpendicular to the vibration direction of the diaphragm 404. In such a magnetic field, each of the first and second drive coils 403 and 411 is provided at a location where the absolute value of the magnetic flux density is maximized within the magnetic gap G. When an alternating electric signal is applied to each of the first and second drive coils 403 and 411, a drive force is generated in each of the first and second drive coils 403 and 411. Such drive forces cause the diaphragm 404 having the first and second drive coils 403 and 411 glued thereon to vibrate, thereby emitting sound.

As described above, in the forth embodiment, it is possible to provide an electroacoustic transducer having a rectangular solid-like shape. By forming a magnetic circuit using two pairs of magnets, it is made possible to prevent the magnetic operating point from being lowered due to reduction in thickness of the magnets. Further, by providing the electroacoustic transducer in the shape of a rectangular solid, it is made possible to improve the space factor when attaching the electroacoustic transducer to a portable information terminal device such as a mobile telephone or a PDA, i.e., it is made possible to reduce the space occupied by the electroacoustic transducer in the terminal device.

Further, in the fourth embodiment, the electroacoustic transducer has a dual drive coil structure, and therefore it is possible to increase the total drive force to cause the diaphragm 404 to vibrate. Moreover, since the diaphragm 404 is driven by the two drive coils 303 and 311 placed in different locations, it is easy to control modes of vibration generated during vibration of the diaphragm 404.

As in the case of the third embodiment, the electroacoustic transducer according to the fourth embodiment may include yokes. Specifically, yokes may be provided so as to surround the first through fourth magnets 401, 402, 412, and 413, respectively. When the yokes are provided, magnetic paths are formed by the yokes and the first through fourth magnets 401, 402, 412, and 413. Accordingly, similar to the third embodiment, it is possible to achieve a high magnetic flux density within the magnetic gap G. Conceivable examples of the shape of a yoke include the shapes as shown in FIGS. 9A through 9E. The yoke may be formed of a material different from the material of the casing or may be integrally formed with the casing using the same magnetic material.

In the fourth embodiment, the electroacoustic transducer includes two drive coils, i.e., the first and second drive coils 403 and 411. However, in other embodiments, the electroacoustic transducer may include only one of the first drive coil 403 and the second drive coil 411.

In the fourth embodiment, the diaphragm 404 has an oval-like shape when viewed from above. However, in other embodiments, the diaphragm may have a rectangular shape. Moreover, each of the first and third arc portions 404*a* and 404*c* of the diaphragm 404 has an arc-like cross section. However, such portions may have a wave-like, oval-like, or cone-like cross section in order to satisfy requirements for both the minimum resonance frequency and the maximum amplitude of vibration of the diaphragm 404.

In the fourth embodiment, two pairs of magnets are provided in the electroacoustic transducer. However, six or more magnets, i.e., three or more pairs of magnets, may be used. In such a case, it is necessary to increase the number of drive coils. For example, in the case of using three pairs of magnets, two drive coils are required.

Fifth Embodiment

Figure 12A:
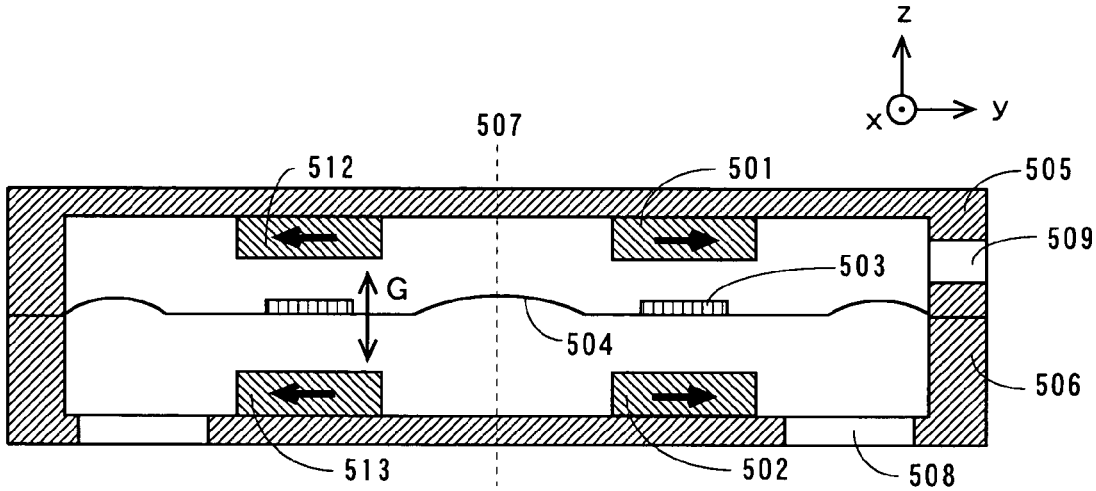
FIG. 12A is a cross-sectional view of an electroacoustic transducer according to a fifth embodiment of the present invention.
Figure 12B:
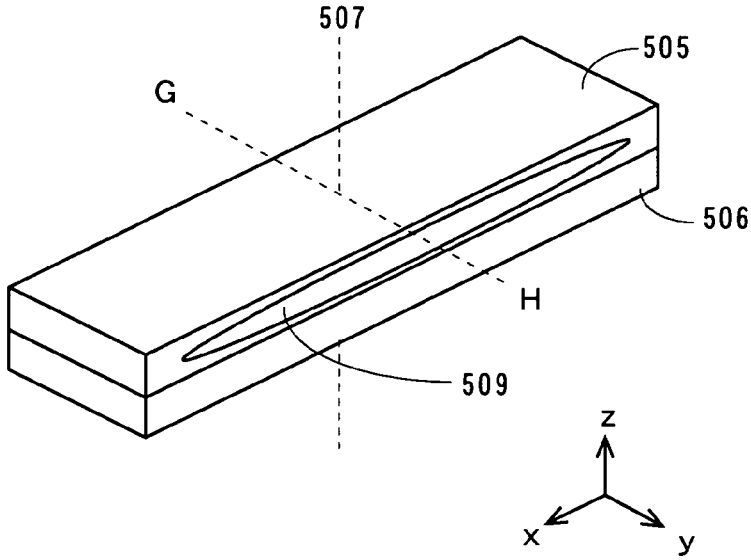
FIG. 12B is a perspective view of the electroacoustic transducer according the fifth embodiment.

An electroacoustic transducer according to a fifth embodiment of the present invention will now be described. FIGS. 12A and 12B are views used for explaining the structure of the electroacoustic transducer according to the fifth embodiment. Specifically, FIG. 12A is a cross-sectional view of the electroacoustic transducer according to the fifth embodiment. FIG. 12B is a perspective view of the electroacoustic transducer according the fifth embodiment.

In FIG. 12A, a cross section of the electroacoustic transducer taken along line G-H of FIG. 12B is shown. The electroacoustic transducer illustrated in FIG. 12A includes: a first magnet 501; a second magnet 502; a third magnet 512; a fourth magnet 513; a drive coil 503; a diaphragm 504; and cases 505 and 506. Note that a center axis 507 shown in FIGS. 12A and 12B is a straight line which passes through the center of the cases 505 and 506 and the drive coil 503. The structure of the electroacoustic transducer according to the fifth embodiment illustrated in FIG. 12A is similar to the structure of the electroacoustic transducer according to the fourth embodiment except for the following first and second differences.

The first difference is that directions in which the first through fourth magnets 501, 502, 512, and 513 are provided. In the fifth embodiment, the first through fourth magnets 501, 502, 512, and 513 are magnetized in the y-axis direction shown in FIGS. 12A and 12B. The first through fourth magnets 510, 502, 512, and 513 are arranged such that each magnet has a magnetization direction which is opposite to the magnetization direction of a magnet opposing with respect to the center axis 507. Specifically, the magnetization of the first magnet 501 is opposite to the magnetization direction of the third magnet 512, and the magnetization of the second magnet 502 is opposite to the magnetization direction of the fourth magnet 513. Such arrangement of the magnets generates drive forces having the same direction in opposite sides of the drive coil 503 with respect to the center axis 507. In this arrangement of the first through fourth magnets 510, 502, 512, and 513, each magnet has the same magnetization direction as that of a magnet opposing with respect to the diaphragm 504. Specifically, the magnetization of the first magnet 501 is the same as the magnetization direction of the second magnet 502, and the magnetization of the third magnet 512 is the same as that of the fourth magnet 513. In FIG. 12A, the magnetization direction of the first and second magnets 501 and 502 is rightward, and the magnetization direction of the third and fourth magnets 512 and 513 is leftward. As in the case of the second embodiment, in the fifth embodiment, the magnetization directions of the first through fourth magnets 501, 502, 512, and 513 are parallel to the plane of the diaphragm 504 and perpendicular to the direction of an electric current flowing through the drive coil 503. Thus, generated magnetic fluxes are oriented to be perpendicular to the direction of vibration of the diaphragm 504 in the vicinity of the plane of the diaphragm 504.

In the fifth embodiment, the magnetization directions of the first through fourth magnets 501, 502, 512, and 513 correspond to the y-axis direction as shown in FIGS. 12A and 12B. However, the magnetization directions may correspond to the x-axis direction so long as they are perpendicular to the direction of vibration of the diaphragm 504. Note that in order to increase the drive force generated in the drive coil 503, it is preferred that the magnetization directions of the first through fourth magnets 501, 502, 512, and 513 correspond to the direction of the shorter sides of the drive coil 503, i.e., the y-axis direction.

The second difference is that an air hole 509 is provided in a side face of the case 505. This allows the electroacoustic transducer according to the fifth embodiment to be placed in an electronic apparatus so as to be oriented in a direction different from the direction in which the electroacoustic transducer according to the fourth embodiment is oriented. Note that air holes 508 are provided in the bottom face of the case 506.

Described next is the operation of the thus-structured electroacoustic transducer. A magnetic field is generated in the vicinity of the drive coil 503 by the first through fourth magnets 501, 502, 512, and 513, and therefore when an alternating electric signal is applied to the drive coil 503, a drive force is generated in the drive coil 503. The drive force causes the diaphragm 504 having the drive coil 503 glued thereon to vibrate, thereby emitting sound.

As described above, in the fifth embodiment, the first through fourth magnets 501, 502, 512, and 513 are magnetized in the y-axis direction as shown in FIGS. 12A and 12B. As in the case of the second embodiment, repulsion occurs between magnetic fluxes emitted by the magnets so that a magnetic field is generated in the magnetic gap G such that magnetic components in the radius direction of the drive coil 503 are dominant. As a result, the magnetic flux density becomes high in the space between the first and second magnets 501 and 502 as well as in the space between the third and fourth magnets 512 and 513. Accordingly, the drive coil 503 can be provided over a wide area as compared to the fourth embodiment. Thus, it is possible to increase, for example, the number of turns and the length of the drive coil 503, thereby increasing the drive force of the drive coil 503. Moreover, since the magnetic flux density is distributed substantially uniformly across each of the above-mentioned spaces, a magnetic flux density variation, which depends on the location of the drive coil 503, is reduced in the vibration direction. Accordingly, it is possible to minimize unevenness in sound pressure level among electroacoustic transducers which is caused during assembly. As described above, the drive coil 203 can be provided over a wide area as compared to the fourth embodiment, and therefore there is a high degree of freedom in designing the shapes of the drive coil 503 and the diaphragm 504.

Further, similar to the fourth embodiment, the electroacoustic transducer according to the fifth embodiment has a rectangular solid-like shape, and therefore it is possible to improve the space factor when attaching the electroacoustic transducer to a portable information terminal device such as a mobile telephone or a PDA.

Furthermore, similar to the diaphragm described in the fourth embodiment, the diaphragm 504 in the fifth embodiment has an oval-like shape when viewed from above. However, such portions may have a wave-like, oval-like, or cone-like cross section in order to satisfy requirements for both the minimum resonance frequency and the maximum amplitude of vibration of the diaphragm 504.

A variation example of the above-described first through fifth embodiments is described next. The first through fifth embodiments have been described with respect to the case where a conventional winding coil is used as a drive coil and the drive coil is separated from a diaphragm. On the other hand, the variation example is characterized in that the diaphragm and the drive coil are integrally formed with each other.

Figure 13A:
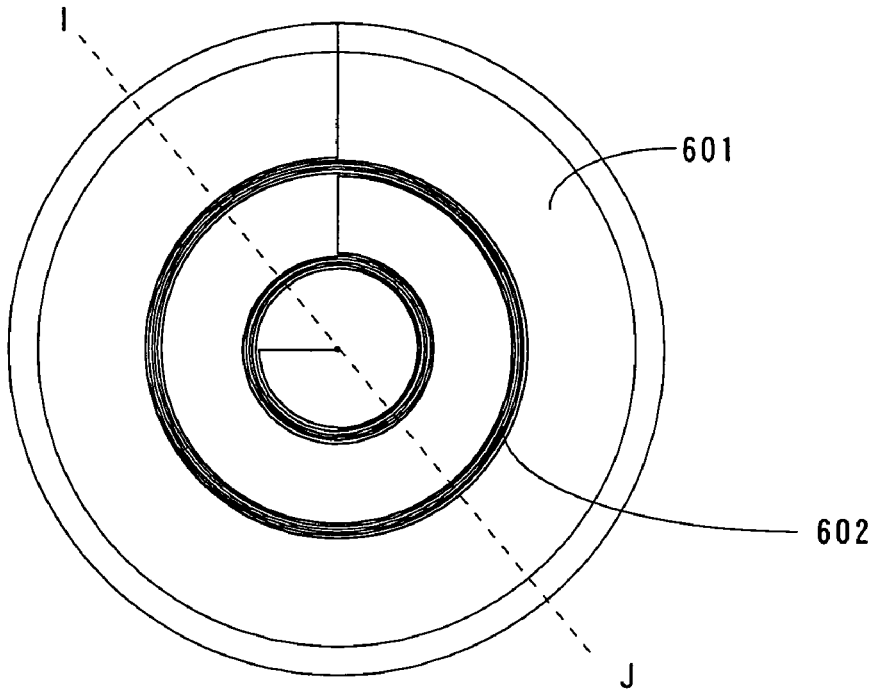
FIG. 13A is a top view illustrating a diaphragm and a drive coil of a variation example of the first through fifth embodiments.
Figure 13B:
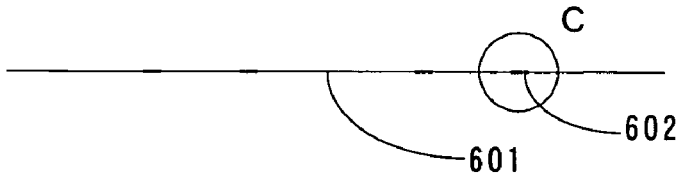
FIG. 13B shows a cross section of the diaphragm taken along line I-J of FIG. 13A.
Figure 13C:
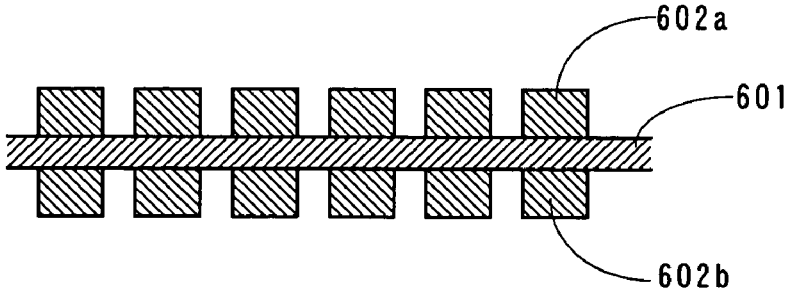
FIG. 13C is an enlarged view of a circled portion shown in FIG. 13B.

FIGS. 13A through 13C are views used for explaining the diaphragm and the drive coil in the variation example of the first through fifth embodiments. Specifically, FIG. 13A is a top view illustrating the diaphragm and the drive coil of the variation example, FIG. 13B is a cross-sectional view of the diaphragm, and FIG. 13C is a cross-sectional view of the drive coil. Note that FIG. 13B shows a cross section of the diaphragm taken along line I-J of FIG. 13A, and FIG. 13C is an enlarged view of a circled portion shown in FIG. 13B.

As can be seen from FIGS. 13A through 13C, a diaphragm 601 and a drive coil 602 are integrally formed with each other. The diaphragm 601 has a circular shape. Accordingly, other elements used in the electroacoustic transducer according to this variation example are the same as those used in the electroacoustic transducer described in any one of the first through third embodiments. The diaphragm 601 is flat-shaped as in the case of the first embodiment. In the variation example of FIGS. 13A through 13C, the drive coil 602 are formed by two coils, i.e., inner and outer coils. However, the drive coil 602 may be formed by a single coil. In the variation example of FIGS. 13A through 13C, although the diaphragm 601 and the drive coil 602 are circular shaped, they may have a rectangular or oval shape. In such a case, other elements used in the electroacoustic transducer may be the same as those used in the electroacoustic transducer described in any one of the fourth and fifth embodiments.

The variation example differs from the first through fifth embodiments in that the drive coil 602 is integrally formed with the diaphragm 601. For example, the drive coil 602 may be integrally formed with the diaphragm 601 by etching. Described below is how the drive coil 602 is integrally formed with the diaphragm 601 by etching. Firstly, a copper material is glued and laminated onto a diaphragm base material such as polyimide. Next, a photoresist layer is formed on the laminated copper material, and thereafter the photoresist layer is exposed to light and developed to form an etching resist on the copper material. Then, copper traces are formed on the diaphragm base material by removing the etching resist. Note that the drive coil 602 may be formed on one or both faces of the diaphragm 601. As can be seen from FIGS. 13B and 13C, first and second coils 602*a* and 602*b* are formed on opposite faces of the diaphragm 601. That is, the drive coil 602 shown in FIGS. 13A through 13C is a dual layered drive coil including the first and second coils 602*a* and 602*b*.

By integrally forming the diaphragm 602 with the drive coil 601 in the above-described manner, it is made possible to reduce the stress generated in the drive coil 602 when the diaphragm 601 vibrates. Accordingly, it is possible to prevent the breakage of the drive coil 602, ensuring the reliability of the electroacoustic transducer. Further, it is not necessary to bond the diaphragm and the drive coil together or to connect lead wires during the production of the electroacoustic transducer, leading to easy production of the electroacoustic transducer. Furthermore, it is possible to increase the degree of freedom in designing the pattern of the drive coil, thereby making it possible to easily provide a dual structured drive coil (see FIG. 13A) which is not easily realized by a conventional winding coil.

Note that the diaphragm can be integrally formed with the drive coil by an additive process as can be formed by etching. Although the variation example has been described with respect to the case where the drive coil has a dual layered structure, an additional layer(s) may be provided on the dual layers.

Figure 14A:
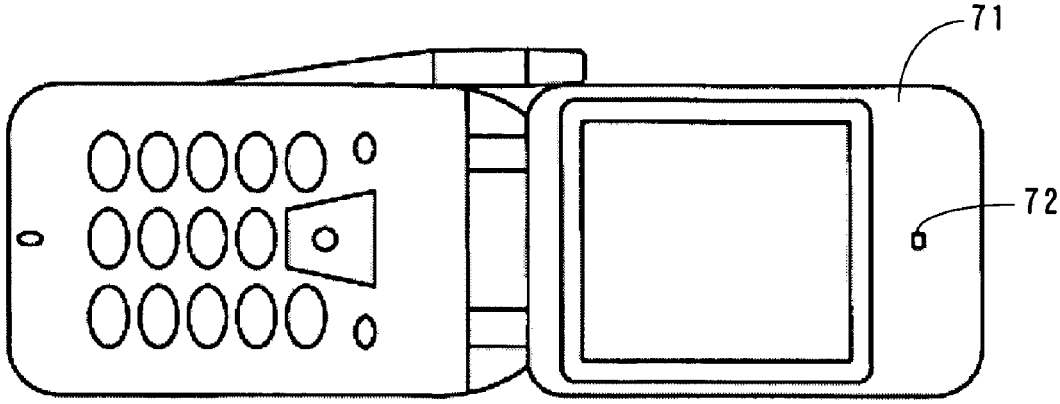
FIG. 14A is a front view of a mobile telephone in an applied example of the first through fifth embodiments.
Figure 14B:
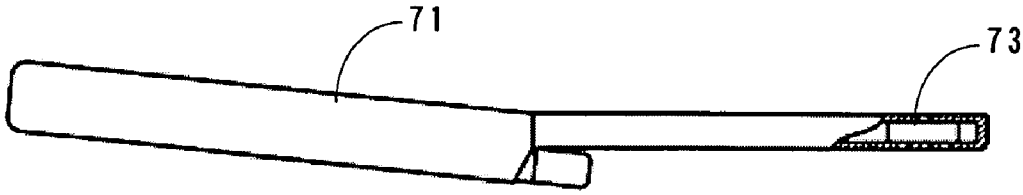
FIG. 14B is a cutaway view of the mobile telephone in the applied example of the first through fifth embodiments.
Figure 15:
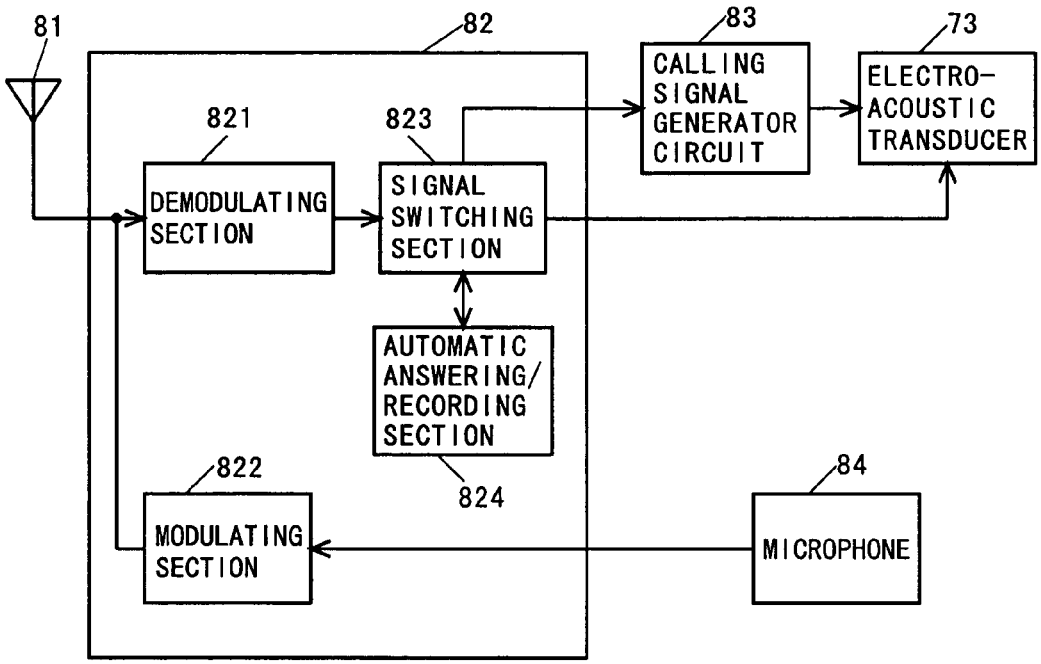
FIG. 15 is a block diagram schematically illustrating the structure of the mobile telephone described in the applied example of the first through fifth embodiments.

Described next is an applied example where the electroacoustic transducer as described in the first through fifth embodiment is used in a mobile telephone as an exemplary electronic apparatus. FIGS. 14A and 14B are views showing the external appearances of the mobile telephone according to the applied example of the first through fifth embodiments. Specifically, FIG. 14A is a top view of the mobile telephone, and FIG. 14B is a cutaway view of the mobile telephone. FIG. 15 is a block diagram schematically illustrating the structure of the mobile telephone described in the applied example.

Referring to FIGS. 14A and 14B, the mobile telephone includes: a body 71; a sound hole 72 provided in the body 71; and an electroacoustic transducer 73 described in one of the first through fifth embodiments. The electroacoustic transducer 73 is provided in the body 71 such that its air holes face the sound hole 72.

Referring to FIG. 15, the mobile telephone further includes: an antenna 81; a transmitter/receiver circuit 82; a calling signal generator circuit 83; and a microphone 84. The transmitter/receiver circuit 82 includes a demodulating section 821, a modulating section 822, a signal switching section 823, and an automatic answering/recording section 824.

The antenna 81 is operable to receive modulated radio waves outputted from a closest base station. The demodulating section 821 is operable to demodulate the modulated radio waves received by the antenna 81 into a signal, and to supply the signal to the signal switching section 823. The signal switching section 823 is a circuit operable to switch signal processing in accordance with the details of the signal. Specifically, when the signal is an incoming call signal, the signal is supplied to the calling signal generator circuit 83. Alternatively, when the signal is an audio signal, the signal is supplied to the electroacoustic transducer 73. Alternatively still, when the signal is an audio signal for automatic answering/recording, the signal is supplied to the automatic answering/recording section 824. The automatic answering/recording section 824 is formed by, for example, a semiconductor memory. When the mobile telephone is on, the audio signal for automatic answering/recording is recorded, as the caller's message, to the automatic answering/recording section 824, and when the mobile telephone is located outside the service area or the mobile telephone is off, the caller's message is recorded to a storage device of the closes base station. The calling signal generator circuit 83 is operable to generate a calling signal and supply the generated signal to the electroacoustic transducer 73. The microphone 84 is of a small type as used in a conventional mobile telephone. The modulating section 822 is a circuit operable to modulate a dial signal or an audio signal converted by the microphone 84, and to output the modulated signal to the antenna 81.

Described below is the operation of the thus-structured mobile telephone. When modulated radio waves outputted from a base station are received by the antenna 81, the received radio waves are demodulated into a baseband signal by the demodulating section 821. Upon detection of an incoming call signal from the baseband signal, the signal switching section 823 outputs the incoming call signal to the calling signal generator circuit 83 in order to notify the user of the occurrence of an incoming call. Upon receipt of the incoming call signal from the signal switching section 823, the calling signal generator circuit 83 outputs to the electroacoustic transducer 73 a calling signal of pure tones in an audible frequency band or a call signal of a complex tone of such pure tones. The electroacoustic transducer 73 converts the calling signal into sound, and outputs the sound as a ring tone. The user is made aware of the occurrence of the incoming call by hearing the ring tone outputted from the sound hole 72 of the mobile telephone via the electroacoustic transducer 73.

When the user answers the phone, the signal switching section 823 adjusts the level of the baseband signal, and then outputs an audio signal directly to the electroacoustic transducer 73. The electroacoustic transducer 73 serves as a receiver/loudspeaker to reproduce the sound signal. The voice of the user is collected by the microphone 84, and converted into an electric signal. The electric signal is inputted into the modulating section 822 and then modulated and converted into a prescribed carrier wave. The carrier wave is outputted from the antenna 81.

In the case where the mobile telephone is on and set into the automatic answering/recording mode by the user, the caller's message is recorded to the automatic answering/recording section 824. Note that in the case where the mobile telephone is off, the caller's message is temporarily stored in the base station. When the user operates keys of the mobile telephone to request reproduction of the stored message, the signal switching section 823, responsive to the user's request of reproduction, obtains an audio signal of the stored message from the automatic answering/recording section 823 or the base station. Then, the signal switching section 823 adjusts the output level of the audio signal to a prescribed level, and outputs the audio signal to the electroacoustic transducer 73. In this case, the electroacoustic transducer 73 serves as a receiver/loudspeaker to output the message.

In the above applied example, although the electroacoustic transducer 73 is directly attached to the body 71, the electroacoustic transducer 73 may be mounted on a circuit board within the mobile telephone and connected to the body 71 via a port. Even in the case of being provided in electronic apparatuses other than the mobile telephone, the acoustic transducer 73 operates in a manner as described above and achieves a similar effect. In addition to the mobile telephone, the electroacoustic transducer 73 can be included in, for example, a beeper, and can be used for reproducing alarm sound, a melody, or other sound. Alternatively, the electroacoustic transducer 73 can be included in a television set in order to reproduce sound and music. Alternatively still, the electroacoustic transducer 73 can be included in other electronic apparatuses, such as a PDA, a personal computer, and a car navigation system. As described above, by providing the electroacoustic transducer 73 in an electronic apparatus, the electronic apparatus is enabled to reproduce alarm sound, voice, etc.

While the invention has been described in detail, the foregoing description is in all aspects illustrative and not restrictive. It is understood that numerous other modifications and variations can be devised without departing from the scope of the invention.

What is claimed is:

1. An electroacoustic transducer comprising:

a diaphragm;

a casing for supporting the diaphragm;

a drive coil provided on the diaphragm;

a sole first magnetic structure having a first space in a center thereof provided within the casing such that a center axis, which is a straight line perpendicular to a plane of the diaphragm, passes through a center of the drive coil and penetrates the first space; and a sole second magnet magnetic structure having a second space in a center thereof and provided within the casing on a side opposed to the first sole magnetic structure with respect to the diaphragm, such that the center axis penetrates the second space, wherein the sole first magnetic structure is oriented such that a magnetization direction thereof is parallel to the center axis, wherein the sole second magnetic structure is oriented such that a magnetization direction thereof is opposite to that of the sole first magnetic structure, and wherein the drive coil is located where the diaphragm intersects with a straight line which passes through an outer edge of the sole first magnetic structure and an outer edge of the sole second magnetic structure and which straight line is parallel to the center axis.

2. The electroacoustic transducer according to claim 1, wherein each of the first and second magnetic structures has a ring-like shape, and is placed such that the center axis passes through a center thereof.

3. The electroacoustic transducer according to claim 2, wherein the first and second magnetic structures have a same columnar external shape, and wherein the drive coil has a circular shape and is located where a line perpendicular to an outer circumference of the first magnetic structure projects onto the diaphragm.

4. The electroacoustic transducer according to claim 2, wherein the first and second magnetic structures have a same columnar external shape, and wherein the drive coil has a circular shape and is located where a line perpendicular to an inner circumference of the first magnetic structure projects onto the diaphragm.

5. The electroacoustic transducer according to claim 2, wherein the first and second magnetic structures have a same columnar external shape, and wherein the drive coil includes:

a circular inner circumference coil; and a circular outer circumference coil provided outside of the circular inner circumference coil and having a winding direction opposite to that of the circular inner circumference coil.

6. The electroacoustic transducer according to claim 5, wherein the circular inner circumference coil is located where a line perpendicular to an inner circumference of the first magnetic structure projects onto the diaphragm, and wherein the circular outer circumference coil is located where a line perpendicular to an outer circumference of the first magnetic structure projects onto the diaphragm.

7. The electroacoustic transducer according to claim 1, wherein the drive coil is located where an absolute value of the density of magnetic fluxes generated on the plane of the diaphragm by the first and second magnetic structures is maximized.

8. The electroacoustic transducer according to claim 1, wherein the first and second magnetic structures have a same shape and structure.

9. The electroacoustic transducer according to claim 1, wherein the diaphragm has a shape of one of a circle, an oval, and a rectangle.

10. The electroacoustic transducer according to claim 1, wherein the casing has a shape of one of a column, an elliptic cylinder, and a rectangular solid.

11. The electroacoustic transducer according to claim 1, further comprising:

a first yoke provided on at least a part of a periphery of the first magnetic structure; and a second yoke provided on at least a part of a periphery of the second magnetic structure.

12. The electroacoustic transducer according to claim 11, wherein a gap is provided between a portion of the first magnetic structure and a portion of the first yoke; and wherein a gap is provided between a portion of the second magnetic structure and a portion of the second yoke.

13. The electroacoustic transducer according to claim 11, wherein the first and second yokes are integrally formed with a part of the casing.

14. The electroacoustic transducer according to claim 1, wherein the drive coil has a shape of one of a circle, an oval, and a rectangle.

15. The electroacoustic transducer according to claim 1, wherein the drive coil is integrally formed with the diaphragm.

16. The electroacoustic transducer according to claim 1, wherein the drive coil is formed on opposite faces of the diaphragm.

17. The electroacoustic transducer according to claim 1, wherein the casing has at least one hole.

18. An electronic apparatus including the electroacoustic transducer of claim 1.

* * * * *